US008245662B2

(12) United States Patent
Gerhardt et al.

(10) Patent No.: US 8,245,662 B2
(45) Date of Patent: Aug. 21, 2012

(54) METHOD AND CONFIGURATION FOR DYNAMIC CONTROL OF THE LIQUID SUPPLY TO A MOISTURIZING STORAGE MEANS

(75) Inventors: Thomas Gerhardt, Berlin (DE); Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 1293 days.

(21) Appl. No.: 11/833,737

(22) Filed: Aug. 3, 2007

(65) Prior Publication Data

US 2008/0029220 A1 Feb. 7, 2008

(30) Foreign Application Priority Data

Aug. 3, 2006 (DE) ..... 10 2006 038 222

(51) Int. Cl.
*B05C 1/06* (2006.01)
*B05C 1/08* (2006.01)
*B05C 11/00* (2006.01)
*B65C 9/22* (2006.01)

(52) U.S. Cl. ..... 118/667; 118/663; 118/665; 118/668; 118/256; 118/260; 118/264; 118/266; 118/268; 156/357

(58) Field of Classification Search ..... 118/665; 156/357
See application file for complete search history.

(56) References Cited

U.S. PATENT DOCUMENTS 2,316,153 A * 4/1943 Brown ..... 324/649
3,593,337 A * 7/1971 Ellison ..... 340/870.34
3,876,916 A * 4/1975 Stoakes ..... 361/280
4,325,251 A * 4/1982 Kanegae ..... 73/114.61
4,354,051 A * 10/1982 Kutnyak ..... 174/47
4,876,664 A * 10/1989 Bittorf et al. ..... 700/2
4,879,664 A * 11/1989 Suyama et al. ..... 700/186
4,968,946 A * 11/1990 Maier ..... 324/671

(Continued)

FOREIGN PATENT DOCUMENTS

DE 198 45 832 A1 4/2000

(Continued)

OTHER PUBLICATIONS

Translation of EP 988996A1.*

(Continued)

*Primary Examiner* — Dah-Wei Yuan
*Assistant Examiner* — Binu Thomas
(74) *Attorney, Agent, or Firm* — Laurence A. Greenberg; Werner H. Stemer; Ralph E. Locher

(57) ABSTRACT

A method and a configuration provide dynamic control of a liquid supply for a moisturizing storage device for sealing glued edges of a envelope flap of letter envelopes. Once a measured value has been measured for a sealing liquid which is stored in the tank of a moisturizing apparatus, the type of sealing liquid that is used is qualitatively analyzed on the basis of the measured value and of at least one material parameter as a comparison value. The amount of liquid stored in the moisturizing storage device is then measured by at least one further measurement to allow dynamic control of the liquid supply to the moisturizing storage device as a function of the material parameter and of at least one measured value, which is related to the liquid consumption, in the result of the at least one measurement of the amount of liquid stored in the moisturizing storage device.

17 Claims, 12 Drawing Sheets

U.S. PATENT DOCUMENTS

| | | | | |
|---|---|---|---|---|
| 5,220,130 | A * | 6/1993 | Walters | 174/36 |
| 5,289,211 | A * | 2/1994 | Morandotti et al. | 347/7 |
| 5,294,909 | A * | 3/1994 | Frazier | 338/26 |
| 5,519,397 | A * | 5/1996 | Chapotot et al. | 341/155 |
| 6,155,664 | A * | 12/2000 | Cook | 347/7 |
| 2001/0046551 | A1 | 11/2001 | Falck et al. | |
| 2005/0034518 | A1* | 2/2005 | Wamhof et al. | 73/227 |
| 2005/0067108 | A1 | 3/2005 | Beckstrom | |
| 2005/0174397 | A1* | 8/2005 | Scardovi et al. | 347/85 |

FOREIGN PATENT DOCUMENTS

EP 0 988 996 A1 3/2000

EP 988996 A1 * 3/2000

OTHER PUBLICATIONS

Shinskey: "Process Control Systems—Applications, Design and Tuning" 1996, McGraw-Hill, New York, USA, XP 002570365, ISBN: 0070571015, line 1 p. 74, line 19, pp. 323-334, Drawings 10.8, 10.10, 10.12.

European Search Report dated Mar. 2010.

* cited by examiner

Analog Multiplexer

METHOD AND CONFIGURATION FOR DYNAMIC CONTROL OF THE LIQUID SUPPLY TO A MOISTURIZING STORAGE MEANS

CROSS-REFERENCE TO RELATED APPLICATION

This application claims the priority, under 35 U.S.C. §119, of German application DE 10 2006 038 222.6, filed Aug. 3, 2006, the prior application is herewith incorporated by reference in its entirety.

BACKGROUND OF THE INVENTION

Field of the Invention

The invention relates to a method and a configuration for dynamic control of a liquid supply to a moisturizing storage device for a moisturizing apparatus for the glued edge of the envelope flap of letter envelopes, by which the letter envelopes are sealed. This configuration is either a component of a letter separating apparatus with a moisturizing apparatus of the type mentioned initially, or is a component of a separate letter envelope moisturizer and sealer station.

A configuration for supplying the liquid to a moisturizing apparatus for the glued edge of the envelope flap of letter envelopes is known as a component of a letter separating apparatus from published, non-prosecuted German patent application DE 198 45 832 A1. The liquid supply of the moisturizing storage device is provided from a liquid tank by a pump, whose power is matched to the transport speed and paper quality of the letter envelopes, in particular to the characteristics of the glued edge of the envelope flap. When the apparatus is started, the pump is activated and the moisturizing storage device stores a specific amount of liquid, which is emitted to the glued edge of the envelope flap when the latter passes through the apparatus. A sensor is arranged in the area of the moisturizing storage device (e.g. sponge) in the movement path of the envelope flaps. The sensor produces a signal to initiate the pump only when an envelope flap passes it. The liquid is therefore then supplied in order to ensure that the sponge does not dry out. Unnecessary liquid transport during transport pauses is avoided by no signal being emitted from the sensor. The amount of liquid which is sufficient for the largest glued edge for mixed post is then supplied for the next envelope. The excess amount of liquid drips off into a collecting trough, which is pumped away by the pump to the liquid tank. The capability for manual initiation of the pump via the keyboard of the franking machine allows rough presetting of the pump power. On the other hand, a further sensor in the return flow path detects the amount of liquid being fed back to the liquid tank. The measurement result is converted to a further signal for pump control, to allow optimization of the amount of liquid to be supplied from the pump to the moisturizing storage device. This generally ensures adequate moisturizing of every glued edge, thus allowing reliable sealing of the letter envelopes. The paper quality of the various letter envelopes is, however, different such that the functional reliability is not achieved for all types of letter envelopes, particularly when the transport speed of the items for postage is very high. The return-flow sensor which is arranged in the liquid return-flow path in order to monitor the amount of liquid fed back from the collecting trough reacts too late to changes in the amount of liquid in the moisturizing storage device because, in this case, only the amount of excess liquid is monitored, and the moisturizing storage device is always kept in a maximum moisture state by this configuration, without too much liquid being wasted. It has therefore until now not been effectively possible to determine the correct amount of water which is applied to the envelope. When mixed envelopes of different types of paper (mixed post) are being sealed, this leads to problems. The various envelope and/or paper types require different amounts of liquid (water), for physical reasons, in order to be sealed optimally. During the moisturizing process, the system results in too much water being supplied initially when the sponge sucks this up when the appliance is switched on. An equilibrium amount of water is not achieved until after a number of sealing operations, during oscillation for each moisturizing process followed by sealing of letter flaps. This results in the first envelopes being too wet and in water-sensitive printing, which is produced using ink-jet printing technology, being smudged. This leads to difficulties in particular when franking very small amounts of post.

The previous control system is too inert for high-speed mixed-post processing since it only ever reacts when a specific filling level in the overflow container is overshot or undershot. This fact becomes more evident since it is known that only about 50 mg of water is required for clean and secure sealing of an average letter flap. The control of the amount of water in the millimeter range would be too inaccurate when using the apparatus described in published, non-prosecuted German patent application DE 198 45 832 A1. The determination of the correct amount of water which is applied to the envelope via the sponge has not been effectively possible until now. The use of a keyboard to set the amount of water is feasible only by the trial and error method. The customer must therefore first carry out a number of trials for each envelope type and exclude spurious results in the process, in order to achieve a good sealing result. When using mixed post, empirical values must be set, but there is never a 100% guarantee of a good sealing result.

When using mains water, chalk is deposited on the sponge after a short time, making correct moisturization more difficult. Bacteria or mold growth on the sponge can result in a foul or musty smell after a lengthy operating time. This can likewise adversely affect the moisturization of the envelope flaps, if it changes the characteristics of the sponge.

BRIEF SUMMARY OF THE INVENTION

It is accordingly an object of the invention to provide a method and a configuration for dynamic control of the liquid supply to a moisturizing storage device that overcome the above-mentioned disadvantages of the prior art methods and devices of this general type, which improves the functional reliability of a configuration for supplying liquid to a moisturizing apparatus for the glued edge of the envelope flap of letter envelopes. Irrespective of the characteristics of the letter envelopes in general and of the glued edges in particular, the aim is to always adequately moisturize the latter without applying too much excess liquid. In order to improve the functional reliability, both the moisturizing storage device and the liquid should have defined characteristics which as far as possible remain unchanged throughout the time period of the control process.

The invention is based on the object of providing a method and a configuration for dynamic control of the liquid supply to a moisturizing storage device, which makes it possible to avoid over moisturizing on start-up and to control the liquid supply more accurately during operation. This ensures that an adequate amount of liquid can always be transferred to the glued edge even when processing mixed postage items with different paper quality and different envelope sizes.

The invention is based on the idea that a liquid reservoir is used as a moisturizing storage device, which does not have the above-mentioned disadvantages but has defined characteristics and whose large surface area can easily be wet with a liquid, and in that the amount of liquid stored in the moisturizing storage device can be measured.

The method for dynamic control of the liquid supply to a moisturizing storage device for the glued edge of the envelope flap of letter envelopes, by which the letter envelopes are sealed, is characterized by:

a) a measurement of a measured value of a sealing liquid which is stored in the tank of a moisturizing apparatus, and subsequent qualitative analysis of the nature of the sealing liquid used on the basis of the measured value and of at least one material parameter as a comparison value;

b) at least one further measurement of the amount of liquid stored in the moisturizing storage device; and c) dynamic control of the liquid supply to the moisturizing storage device in dependence on the material parameter and of at least one further measured value, which is related to liquid consumption, and is the result of the at least one measurement of the amount of liquid stored in the moisturizing storage device.

Every liquid is distinguished by physical parameters, such as density, surface tension, pH value and specific electrical conductivity. The amount of liquid stored in the moisturizing storage device can be measured indirectly, for example by measuring its weight, in which case, however, a scale is required in order to weigh the moisturizing storage device. The change in its weight corresponds to the change in the amount of liquid. The volume of liquid is obtained from the quotient of the weight and density. When any given liquid fills a predetermined volume, with the density of a specific sealing liquid being known, then this allows qualitative analysis on the basis of the density resulting from the measurements of weight and volume, to determine whether a specific sealing liquid, or some other conventional sealing liquid, is located in the tank of a moisturizing apparatus.

A different indirect measurement method can also be used for the sealing liquid. A conductivity measurement in particular is distinguished in that only a limited number of additional components are required. The liquids used in the past have been subject to the difficulty that, on the one hand, they have excessively low, undefined conductivities and that, on the other hand, the glued edge cannot be penetrated sufficiently quickly. On the one hand, a specific sealing liquid has therefore been developed, which penetrates into the glued edge better, allowing the envelopes to be sealed more quickly. On the other hand, the amount of sealing liquid used is measured and a classification process is carried out in order to analyze whether the tank contains the specific sealing liquid or some other conventional sealing liquid. The invention provides for an electrochemical resistance measurement to be carried out in order to determine a conductance of a specific electrical conductivity of the sealing liquid, on the basis of which the liquid supply to the moisturizing storage device is controlled dynamically. The moisturizing storage device has an electrical non-conductive material as the liquid reservoir, which does not influence the measurement. Based on the qualitative analysis of the type of sealing liquid being used, as carried out in advance, and on indirect measurements of the amount of liquid stored in the moisturizing storage device, it is now possible to control the liquid supply more accurately.

The preferred method for dynamic control of the liquid supply to a moisturizing storage device is characterized by qualitative analysis of the sealing liquid used in the tank and by measurements of the conductance or of the specific electrical conductivity of the sealing liquid used in the moisturizing storage device. In order to control the liquid supply dynamically and more accurately, measurements are taken at different positions in the moisturizing storage device in order to control the liquid supply dynamically and more accurately. With the measurements being taken at different positions in the moisturizing storage device and with more sealing liquid being supplied via a pump to the moisturizing storage device, in reaction to a reduction (in comparison to a basic tank value) in a value which corresponds to the conductance or to the specific electrical conductivity of the sealing liquid used in the moisturizing storage device, particularly in the event of a reduction being found in one of the positions in the moisturizing storage device which is remote from the glued edge of an envelope flap, than in the case of a reduction, measured at the positions close to the glued edge of the envelope flap, of a value which corresponds to the conductance or the specific electrical conductivity of the sealing liquid used in the moisturizing storage device. The correct amount of liquid in the moisturizing storage device, which is used to moisten the glued edge of the envelope flap or the gum on an envelope flap, is determined in a known manner on the basis of a conductivity measurement using at least two electrodes, which are connected by electrical lines to an evaluation and control circuit, which is connected to the electrodes during operation.

A configuration for dynamic control of the liquid supply to a moisturizing storage device has, inter alia, a transducer with at least one voltage divider, containing a series resistance $R_v$ and the electrical resistance $R_m$ of the liquid between two adjacent electrodes which form a measurement cell. When an AC voltage $u_s$ is applied to the voltage divider, this results in a current flow:

$$i=u_m/R_m=u_v/R_v \qquad /1/$$

The current flow i can be calculated from the ratio of the AC voltage element $u_v=(u_s-u_m)$ that is dropped across the series resistance $R_v$ and the value of the series resistance $R_v$. An AC voltage element $$u_m=(u_s-u_v) \qquad /2/$$

can be tapped at the adjacent electrodes of the measurement cell for measurement, and is directly proportional to the electrical resistance $R_m$ of the liquid in the frequency range f=50-120 Hz. The frequency of the AC voltage $u_s$ must be determined empirically.

The AC voltage may have any desired waveform (square-wave, triangular-waveform or sinusoidal). The electrical resistance $R_m$ is inversely proportional to the electrical conductivity $G_m$:

$$u_m=i\cdot R_m=i/G_m \qquad /3/$$

When the AC voltage $u_s$ and the series resistance $R_v$ are known and a measured voltage $u_m$ is measured across the electrical resistance $R_m$ of the liquid in the first step, with the liquid generally being a poor electrical conductor, it is possible to determine the electrical resistance $R_m$ of the liquid. Conversion of the above equations /1/ to /3/ results in:

$$R_m=R_v\cdot u_m/(u_s-u_m) \qquad /4/$$

Equation /5/ applies in general to electrical conductors with a length d and a cross-sectional area A, which oppose a flowing electric current with an electrical resistance R:

$$R=\rho\cdot d/A \qquad /5/$$

One material parameter of the electrical conductor is the electrical resistivity ρ for example the latter is $\rho_{ko}=0.5$ $\Omega mm^2/m$ for example for a constantan alloy composed of 22% Ni, 54% Cu and 1% Mn, and, in comparison to this, $\rho_{Cu}=0.0175$ $\Omega mm^2/m$ for the metal copper.

Alternatively, equations /1/ and /4/ can be converted from the electrical resistance of the conductor to its electrical conductance (equation /6/), with the series resistance $R_v$ having a constant electrical conductance $G_v$=constant over a limited operating temperature range (0° C. to 50° C.):

$$G_m=G_v\cdot u_v/u_m=(u_s-u_m)/(u_m\cdot R_v) \quad /6/$$

Equation /5/ can be converted, after equating it to the equation /6/ and because R=1/G and ρ=1/κ for a representation of the specific electrical conductivity κ:

$$G=\kappa\cdot A/d=G_m=(u_s-u_m)/(u_m\cdot R_v) \quad /7/$$

$$\kappa=d\cdot(u_s-u_m)/(u_m\cdot R_v)\cdot A \quad /8/$$

For a temperature-independent series resistance $R_v$ composed of constantan wire, the electrical conductance $G_v$ is very high because the specific electrical conductivity $\kappa=2\cdot10^{+4}$ $AV^{-1}$ $cm^{-1}$ is also very high. The specific electrical conductivity of copper is $\kappa_{Cu}=5.7\cdot10^{+5}$ $AV^{-1}$ $cm^{-1}=5.7\cdot10^{+5}$ S/cm at 20° C., and its value is therefore higher by an order of magnitude than that of constantan. As a very good electrical conductor, the metal copper is particularly useful for electrical lines.

In contrast to this, every sealing liquid is a very poor electrical conductor. Pure water (desalinated or distilled water) therefore has a very low electrical conductance, because of the lack of charge carriers, that is to say because it has a very low specific electrical conductivity of $\kappa_{H2O}\approx0.6\cdot10^{-6}$ $AV^{-1}$ $cm^{-1}=0.6$ μS/cm. Mains water has more charge carriers and, for example, has a specific electrical conductivity of $\kappa_L\approx0.648\cdot10^{-3}$ $AV^{-1}$ $cm^{-1}=0.648$ mS/cm, whose value is even one to three orders of magnitude higher than the value of distilled water.

Commercially available sealing liquids may have a specific electrical conductivity which is higher than that of mains water by a factor of 1 to 5. A very highly suitable aqueous sealing liquid contains:

i) 1 to 15% of a penetration agent, ii) 0.1% to 1.0% surfactant, iii) 0.1% biocide substances, iv) 0.01 to 1% other aids (dyes and fragrances), and v) remainder up to 100% of purified, softened water (demineralized).

If commercially available sealing liquids, including the mains water that is normally used, are not sufficiently conductive, water-soluble inorganic set-up salts, such as sodium chloride or calcium chloride, or water-soluble organic set-up salts, such as sodium acetate or sodium lactate, can be used, dissolved in water, in order to adjust the conductivity. An AC voltage which is applied to the electrodes of the measurement cell leads to ions that are contained in the sealing liquid being moved in a manner aligned with the electrodes. The more ions, the higher is the current flowing between the electrodes.

The measured resistance value $R_m$ is used first of all to calculate a conductance $G_m$ and then the value of the specific electrical conductivity $\kappa_L$ including the measurement cell parameters, such as the cross-sectional area A and the distance d between the electrodes. The geometric shape of the measurement cell has the now described influences.

The cross-sectional area A also increases the number of charge carriers (ions) within the cross-sectional area A, thus increasing the electrical conductance $G_m$ of the liquid. If the distance d between the electrodes is short, the electrical field strength E rises. This increases the electrical conductivity of the liquid at the same time, because the electrical line current density $J_\kappa=\kappa_L\cdot E$ [in $Am^{-2}$] is a product of the specific electrical conductivity $\kappa_L$ [in $AV^{-1}$ $cm^{-1}$] of the liquid and of the electrical field strength E between the electrodes.

As an alternative to the measurement circuit described above, two components, that is to say the AC voltage source and the series resistance $R_v$ can each be replaced by an AC current source in the measurement circuit, with this AC current source producing an alternating current is, which produces a corresponding measurement voltage μm across the respectively associated measurement cell (across the resistance value $R_m$).

The method for dynamic control of the liquid supply to a moisturizing storage device contains the following steps:

measurement of the conductance or of the specific electrical conductivity of the sealing liquid in the tank, and formation of a basic tank value $X_T$;

classification of the sealing liquid in the tank on the basis of its conductance or specific electrical conductivity by digital comparison of the basic tank value $X_T$ with corresponding comparison values A, B and C, or A and B respectively;

check of the permissibility of the sealing liquid used on the basis of a stored permissibility value Z or Z*, respectively, with a routine for intelligent dynamic sealing liquid supply being started only if the sealing liquid being used is permissible;

measurements of the conductance or of the specific electrical conductivity of the sealing liquid contained at least two different positions in the moisturizing storage device, in the course of the abovementioned routine for intelligent dynamic sealing liquid supply, and formation of a first value $X_1$ corresponding to the conductance or to the specific electrical conductivity of the sealing liquid used, at a first position in the moisturizing storage device, with the first position being closest to the glued edge of an envelope flap, and formation of a second value $X_2$, corresponding to the conductance or to the specific electrical conductivity of the sealing liquid used at a second position in the moisturizing storage device;

comparison of the second value $X_2$ with the basic tank value $X_T$, with a pump for supplying the sealing liquid being operated at high power when the second value $X_2$ is less than the basic tank value $X_T$ and, otherwise;

with a comparison of the first value $X_1$ with the basic tank value $X_T$ being carried out when the second value $X_2$ is not less than the basic tank value $X_T$, with the pump for supplying the sealing liquid being operated at low power in the situation when the first value $X_1$ is less than the basic tank value $X_T$, and, otherwise;

with a comparison of the first value $X_1$ with the second value $X_2$ being carried out when the first value $X_1$ is not less than the basic tank value $X_T$, with the pump being switched off and the moisturizing of envelopes being enabled in the situation when the first value $X_1$ is in a range which is less than the basic tank value $1.02\cdot X_T$ increased by one tolerance value but is greater than the basic tank value $0.98\cdot X_T$ reduced by one tolerance value, and, otherwise;

with a comparison of the first value $X_1$ with the second value $X_2$ being carried out when the first value $X_1$ is not in the above-mentioned range, with the pump for supplying the sealing liquid being operated at low power and the moisturizing of envelopes being enabled, in the situation when the first value $X_1$ is less than the second value $X_2$, and with the pump otherwise being switched off and the moisturizing of envelopes being enabled when the first value $X_1$ is not less than the second value $X_2$.

The pump is once again driven by a motor, which also drives the pump for pumping liquid out of the collecting trough. As before, the supply of liquid to the moisturizing storage device can be regulated by the control system via the pump, although the control system now has a sensitive reaction to conductivity changes in the moisturizing storage device. Once the liquid has entered the moisturizing storage device, it is transported through the moisturizing storage device, driven by the force of gravity. A specific amount of liquid is extracted during the moisturizing of a glued edge, and this leads to local depletion of charge carriers in the moisturizing storage device.

The resultant conductivity changes resulting from the change in quantity of the liquid stored in the moisturizing storage device are linked to one another by a mathematical function. If this is a square function, at least two measurement cells are required at different positions. In contrast, one measurement cell, arranged in the moisturizing storage device, is sufficient if the function is approximately linear.

Other features which are considered as characteristic for the invention are set forth in the appended claims.

Although the invention is illustrated and described herein as embodied in a method and a configuration for dynamic control of the liquid supply to a moisturizing storage device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
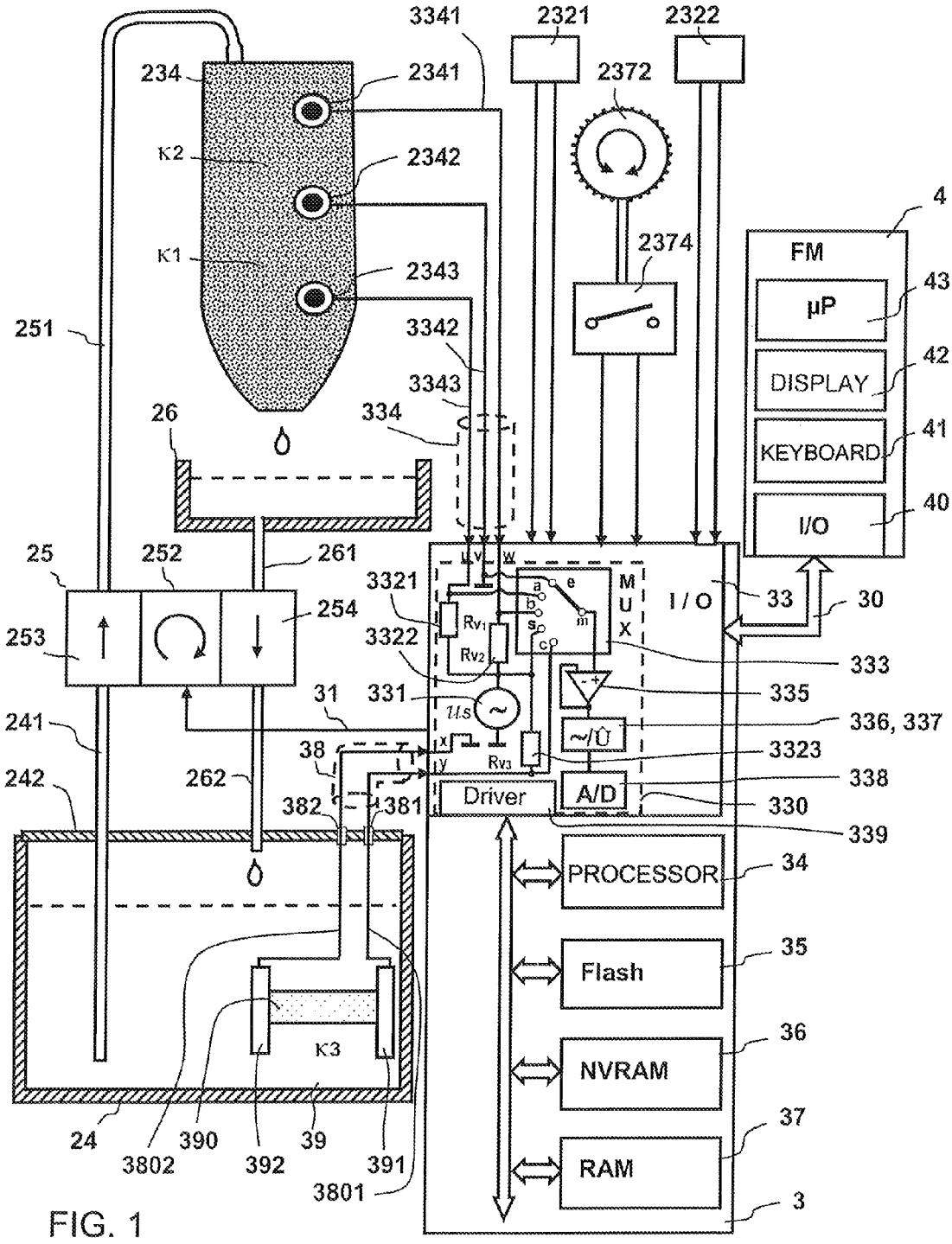
FIG. 1 is a diagrammatic, illustration of a configuration for dynamic control of a liquid supply to a moisturizing storage device for a moisturizing apparatus for application of a sealing liquid to envelope flaps of letter envelopes of a first embodiment according to the invention.

Referring now to the figures of the drawing in detail and first, particularly, to FIG. 1 thereof, there is shown a configuration for dynamic control of the liquid supply to the moisturizing storage device for a moisturizing apparatus for application of a sealing liquid to envelope flaps of letter envelopes, according to a embodiment of the invention. The moisturizing storage device 234 is preferably composed of an open-cell foam, felt or non-woven. The moisturizing storage device 234 is, for example, a sponge, and the manner in which this is mechanically held and arranged in an appliance will be described later. Three electrodes 2341, 2342 and 2343 are preferably arranged in a row in the moisturizing storage device 234 and are connected via electrical lines 3341, 3342 and 3343 to a measurement circuit such that each of them results in a voltage divider, containing a first series resistance $R_{v1}$ connected in series with a first resistance $R_{m1}$, which results from a first specific electrical conductivity $\kappa$1 of the sealing liquid and the geometric dimensions of the measurement cell, and containing a second series resistance $R_{v2}$ connected in series with a second resistance $R_{m2}$, which results from a second specific electrical conductivity $\kappa$2 of the sealing liquid and the geometric dimensions of the measurement cell. The specific electrical conductivities $\kappa$1 and $\kappa$2 result at points which are located one above the other in the row mentioned above, by virtue of the moisturizing storage device 234 being wetted with the liquid, with the row being aligned in the direction of the force of gravity. The electrodes 2341 and 2342 produce a first measurement cell, and the electrodes 2342 and 2343 produce a second measurement cell. The lines which are connected to the electrodes 2341, 2342 and 2343 of the measurement cells are electrically isolated particularly well, and are shielded by a first cable 334. The two series resistances $R_{v1}$ and $R_{v2}$ of the measurement circuit are disposed in a transducer 330 of an input/output unit 33, which also contains a further series resistance $R_{v3}$ for a further series circuit with a third resistance $R_{m3}$, which results from a third specific electrical conductivity κ3 and the geometric dimensions of a third measurement cell 39. The third specific electrical conductivity κ3 is determined via electrodes 391 and 392 of the third measurement cell 39 in the liquid tank 24.

Each voltage divider in the measurement circuit is in each case connected at one end to the ground pole outside the transducer 330, and at the respective other end to a voltage pole of an AC voltage source 331 within the transducer 330. The AC voltage source 331 can produce a preferably symmetrical AC voltage with an undefined waveform, for example a sinusoidal, triangular-waveform or square-wave AC voltage. The frequency of the AC voltage should be in the range from 50 to 120 Hz and should therefore on the one hand be sufficiently high that the measurement is not subject to any polarization effects, while on the other hand it should be sufficiently low that the capacitances of the lines cannot affect the measurement.

Within the transducer 330, each voltage divider has a center tap which is electrically conductively connected to in each case one contact a, b and c of a changeover switch 333. By way of example, the contact a can be connected via switching device to the contact m of the changeover switch 333, in order to measure a measurement voltage $u_m$ at the center tap of the first voltage divider. The AC voltage source 331 is connected to ground potential via the respective other voltage pole. The contacts e and s of the changeover switch 333 are used for measurement of the ground potential and, respectively, of the voltage potential on the voltage dividers. The changeover switch 333 may preferably use electronically controllable switches to form an analog multiplexer, and for control purposes, is connected to a microprocessor. At least one sample and hold (S&H) circuit 337 and one analog/digital converter 338 are connected to the output of the changeover switch 333 via an impedance converter 335. The sample and hold (S&H) circuit 337 converts a measurement AC voltage $u_m$ to a peak DC voltage $\hat{U}m$, which corresponds to the peak value of the DC voltage. The analog DC voltage $\hat{U}m$ is stored in analog form, and is then converted to a digital value $U_m$. The digital value is temporarily stored in digital form in the transducer 330 until it is checked by the microprocessor.

As shown, the transducer 330 may be a component of an input/output unit 33 of an evaluation and control circuit 3, or may be formed separately and connected between the electrodes and the evaluation and control circuit 3. The transducer 330 can be switched and controlled via a driver circuit 339 which is connected to the microprocessor bus.

A collecting trough 26 is disposed underneath the moisturizing storage device 234 in the direction of the force of gravity. A liquid tanker 24 is connected via a flexible supply tube 241, via a first pump chamber 253 of the pump 25 and via a flexible supply tube 251 to the moisturizing storage device 234, and the collecting trough 26 for liquid droplets running out is connected via a flexible outlet tube 261 to a second pump chamber 254 of the pump 25. The second pump chamber 254 is connected via a flexible outlet tube 262 to the liquid tank 24, with the flexible outlet tube 262 ending at the closure piece 242 of the liquid tank 24. The flexible supply tube 241 starts at the lower filling level in the liquid tank 24, passes through the closure piece 242 of the liquid tank 24, and ends at the pump 25. The flexible supply tube 251 to the moisture reservoir starts at the output of the pump 25 and ends above the moisturizing storage device 234 in a guide unit. The flexible supply tube 251 is connected for flow purposes via at least one opening in the guide unit to the moisturizing storage device 234. If the pump 25 is in the form of a multiple flexible-tube pump, the flexible tubes 241 and 251 as well as the flexible tubes 261 and 262, respectively, are in each case combined to form one flexible tube, and are passed through the pump 25.

A tank measurement cell 39 in the liquid tank 24 contains an electrically isolating spacer 390 for two electrodes 391 and 392. The electrical lines 3801, 3802 are both electrically connected to the electrodes 391 and 392, for example via glass bushings 381, 382 arranged in the closure piece 242. The electrical lines which are connected on the outside are protected by a second shielded cable 38. The first and second shielded cables 334 and 38 are intended to have a cable capacitance which is as low as possible.

The result of the liquid wetting of the electrodes of the measurement cells is as follows:

By way of example, distilled water has a specific electrical conductivity of $\kappa_{H2O} \approx 0.6 \cdot 10^{-6}$ $AV^{-1}$ $cm^{-1} = 0.6$ μS/cm and a very low conductance $G_{H2O}$ will be measured.

Mains water has, for example, a specific electrical conductivity of $\kappa_L \approx 0.648 \cdot 10^{-3}$ $AV^{-1}$ $cm^{-1} = 0.648$ mS/cm and, for example, a conductance $G_L$ can be measured, which is three orders of magnitude greater than that of pure (distilled or desalinated) water.

A specific electrical conductivity of $G_S = 4.2 \cdot 10^{-3}$ $AV^{-1}$ $cm^{-1} = 4.2$ mS/cm is achieved by a special aqueous sealing liquid.

A spacer 390 composed of glass in practice has a minimum specific electrical conductivity of $\kappa_{Glass} \approx 10^{-14}$ $AV^{-1}$ $cm^{-1}$ when not wetted by the liquid. The controller 3 does not react to the measurement by means of the tank measurement cell 39 until at least one lower filling level is exceeded. The difference of 8 to 11 orders of magnitude when wetted by the liquid can be clearly detected. The measurement can be used to distinguish between an empty liquid tank 24 and a liquid tank 24 which is not empty. This is true, of course, only when the machine is not moving.

The moisturizing storage device 234 has an electrically isolating storage material with adequate capacity to store the electrically conductive liquid and is fitted, for example, with three electrodes, which are arranged spaced apart from one another in a row, with the row in this case being parallel to the perpendicular to the center of the earth. The microprocessor can use the voltage values measured at different points to draw conclusions about the state of the moisturizing storage device 234, and can drive the motor 253 for the pump 25 when required, in order to supply liquid. This makes it possible to produce a first variant of intelligent dynamic sealing liquid supply (IDS), by which the moisture in the sponge can be controlled by software. The pump 25 can be switched off when no letter envelopes need to be sealed. A switch 2374 which is coupled to an operating button 2372 is used to switch the pump 25 on and off manually. The switch 2374 is connected to an evaluation and control circuit 3, which is in turn connected via a control line 31 to the pump 25, or to its motor 252. Depending on the characteristic of the motor 252, it is controlled by variation of a voltage level or of a pulse repetition frequency. If the pump 25 is in the form of a symmetrical multi-chamber flexible tube pump, the first pump chamber 253 is used to supply the moisture reservoir 234, and the second pump chamber 254 is used to extract excess liquid from the collecting trough 26.

The tank measurement cell 39 is attached to the closure piece 242 on the inside and is electrically connected by an insulated double line 3801, 3802 to the connecting terminals x and y of the transducer 330 on the input/output unit 33 of the evaluation and control circuit 3, which allows an electric alternating current to flow via the electrodes 391, 392 through the liquid, and evaluates the voltage drop. A program memory FLASH 34, a non-volatile memory NVRAM 36 and a main memory RAM 37 are connected for digital evaluation during operation to the processor 34, and the processor 34 is coupled via the bus to the input/output unit 33. When the liquid tank 24 is full, an appropriate signal to reduce the pump power can be supplied from the evaluation and control circuit 3 to the motor 252 for the pump 25. When the liquid tank 24 is empty, an appropriate signal to increase the pump power can be supplied from the evaluation and control circuit 3 to the motor 252. The input/output unit 33 of the evaluation and control circuit 3 is connected bi-directionally to a franking machine 4. The latter likewise has an input/output unit 40, which is connected to a microprocessor controller 43. The keyboard 41 of the franking machine 4 is coupled to the latter. The pump power can be preset manually by the keyboard 41, the microprocessor 43 of the franking machine 4 and via the input/output unit 40. The display 42 can be used for a status display, indicating whether, for example, the moisturizing apparatus is or is not activated. This is particularly advantageous during operation for servicing purposes. The power of the pump 25 can be matched to the transport speed and to the paper quality of the letter envelopes 1 in order in this way to ensure that the glued edges are adequately moisturized. A first sensor 2321 is arranged in the movement path of the envelope flaps in the area of the moisturizing storage device and produces a signal to initiate the pump only when an envelope flap passes the sensor 2321. A second envelope sensor 2322 detects the front edge of the envelope and is used to start the IDS (intelligent dynamic sealing liquid supply). The IDS is advantageously started before a blade detects the envelope flap, and lifts off the envelope. This ensures adequate penetration of the sealing liquid into the moisturizing storage device 234 without over moistening, before an envelope flap passes the first sensor 2321.

The solution according to the invention contains the configuration of electrodes for conductivity measurement for example in a sponge, which is used to apply moisture to the gum on the letter envelope flap. The conductivity measurement offers a sufficiently accurate measurement for the moisture in the sponge, and is sufficiently sensitive to detect very minor changes, and to react to them. However, this is dependent on the use of a sufficiently conductive sealing liquid. Since the commercially available sealing liquids, including the water that is normally used, are not sufficiently conductive, set-up salts, such as sodium chloride, potassium chloride, sodium acetate or sodium lactate can be used, dissolved in the water, in order to adjust the conductivity.

According to published, non-prosecuted German patent application DE 10 2006 014 164.4, a penetration agent is used in addition to water for the sealing liquid. To be precise the pure penetration agent scarcely increases the electrical conductivity with the water, because of its non-ionic character, in the same way as non-ionic surfactants. However, the ethyl lactate which is used as the penetration agent is stabilized in an aqueous solution with sodium lactate (Na lactate). Approximately 1.2% sodium lactate could be used in this case. The increase in the electrical conductivity would be surprisingly clear with this mixture.

Figure 2:
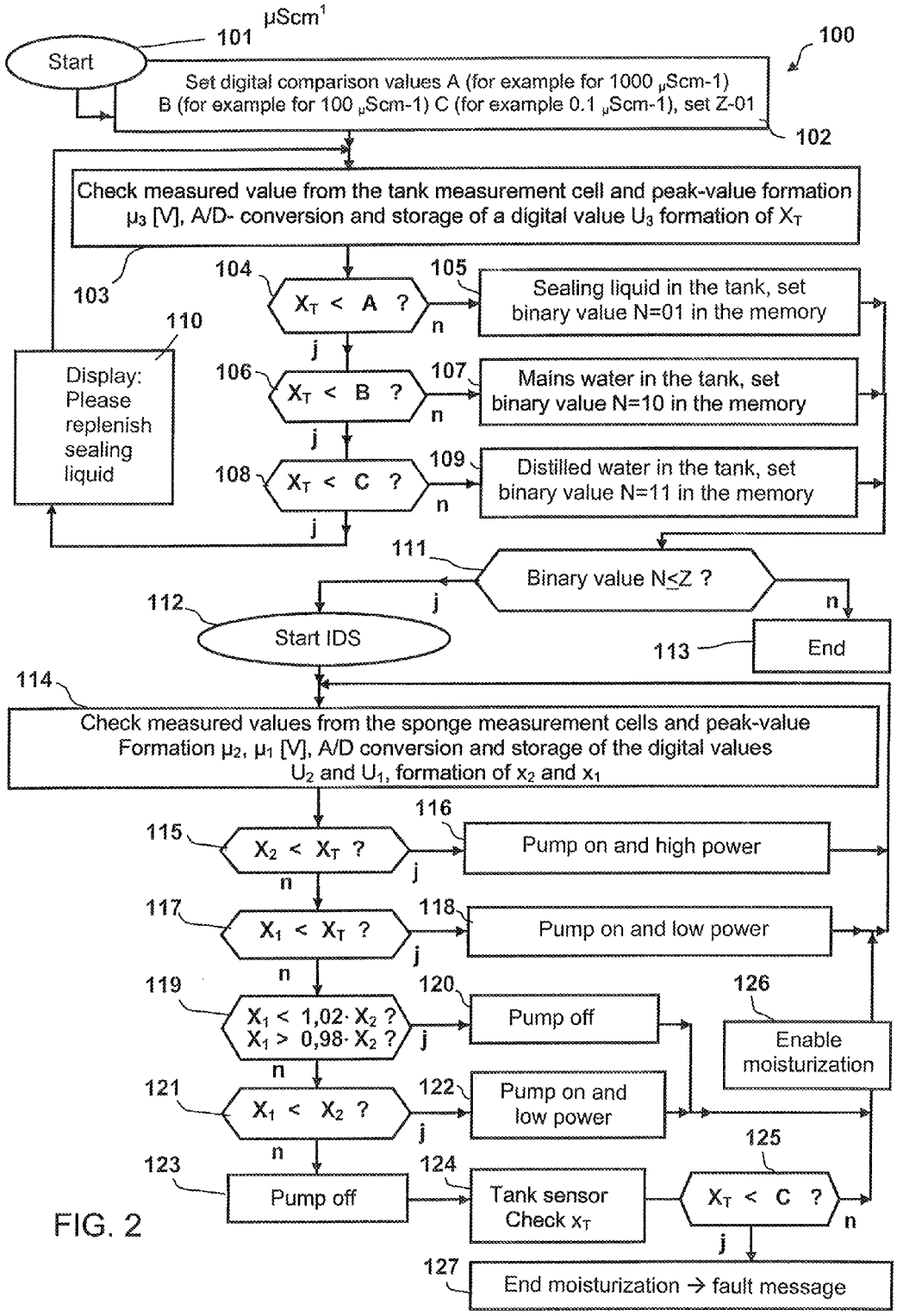
FIG. 2 is a flowchart illustrating a method for dynamic control of the liquid supply according to the first embodiment.

The exemplary embodiment includes the flowchart, as shown in FIG. 2, of a method for dynamic control of the liquid supply according to the first embodiment. This flowchart shows a first step 101 in order to start the method 100 once the machine has been switched on. In a second step 102, digital comparison values A, B and C are stored in associated registers in the non-volatile memory (NVRAM) 36, and a permissibility value Z is set. The digital comparison values A, B and C are first used for classification of the sealing liquid on the basis of its conductance or electrical conductivity. The switch 333 is switched in the next, third step 103, so that its contacts c and m are electrically conductively connected. A tank measurement cell 39 is then checked and, in the process, an analog AC voltage element $u_{m3}$ is sampled at the center tap of the third voltage divider. The third voltage divider contains the series resistance Rv3 and a measurement resistance Rm3=1/$G_3$, which corresponds to the reciprocal $1/G_3$ of a conductance $G_3$ determinable by calculation. The measured analog AC voltage element $u_{m3}$ is rectified and is temporarily stored in analog form as a peak DC voltage value $\hat{U}_3$ in the S&H circuit. The analog value is then converted to a digital value $U_3$ and is temporarily stored in digital form in a memory. After this has been checked by the microprocessor, a digital basic tank value $X_T$ is determined by calculation. The digital maximum value Us of the AC voltage $\hat{u}_s$ and the predetermined series resistance Rv, or its conductance $G_v$ uses as the digital basic tank value $X_T$, either a conductance:

$$G_{m3}=G_v\cdot(U_s-U_3)/U_3 \text{ and } X_T=|G_{m3}| \qquad /9/$$

and/or—corresponding to equation /8/ from the predetermined geometric parameters d and A of the measurement cell, a corresponding value of the specific electrical conductivity:

$$\kappa_m=d\cdot(U_s-U_3)/U_3\cdot R_v\cdot A \text{ and } X_T=|\kappa_m| \qquad /10/.$$

The digital basic tank value $X_T$ is then compared with the digital comparison values A, B and C. Although this is not shown in any more detail in FIG. 2, the calculations are carried out in sub-steps of the third step 103 by the microprocessor. A first checking step 104 is used to find out whether the digital basic tank value $X_T$ is below the first digital comparison value A, with the latter being the highest digital comparison value of all the comparison values A, B and C. A jump is then made to a second checking step 106. Otherwise, if the digital basic tank value $X_T$ is not less than the digital comparison value A, then a jump is made to a step 105 and a first binary value N=01 is set in the memory in order to identify the first state found, that there is sealing liquid in the tank.

A second checking step 106 is used to find out whether the digital basic tank value $X_T$ is less than the second digital comparison value B, with the latter being less than the highest digital comparison value. A jump is then made to a third checking step 108. Otherwise, if the digital basic tank value $X_T$ is not less than the second digital comparison value B, the jump is then made to a step 107 and a second binary value N=10 is set in the memory, in order to identify the second state found, for example in which there is drinking water or mains water in the tank.

A third checking step 108 is used to find out whether the digital basic tank value $X_T$ is less than the third digital comparison value C, with the latter being the smallest digital comparison value. A jump is then made to a fourth step 110 in order to signal, for example in order to report via the display, that the sealing liquid should be replenished.

Otherwise, if the digital basic tank value $X_T$ is not less than the third digital comparison value C, then a jump is made to a step 109 and a third binary value N=11 is set in the memory, in order to identify that the third state has been found, for example that there is distilled water or desalinated water in the tank.

The process then jumps back from the step 110 to the start of the third step 103. However, if the sealing liquid has now been replenished, one of the steps 105, 107 and 109 is then carried out, thus classifying the sealing liquid used in the tank.

A jump is made from the steps 105, 107 and 109 to a fourth checking step 111, and the binary value N set in the memory is compared with the stored permissibility value Z, and a start step 112 for the intelligent dynamic sealing liquid supply (IDS) is reached when the binary value N is less than or equal to the stored permissibility value Z. Otherwise, that is to say if the binary value N for identification of the tank state is not less than or equal but is greater than the stored permissibility value Z, then the routine is ended (step 113).

The IDS routine therefore cannot be started if the sealing liquid used in the tank does not comply with the requirements of the permissibility value Z. Once the IDS routine has been started in the step 114, a routine is carried out, containing a number of subroutines. The switch 335 is switched in step 114 such that its contacts a and m or b and m are electrically conductively connected. The measurement cells of the moisturizing storage device are then checked, and in the process analog AC voltage elements $u_1$ and $u_2$ are sampled at the center tap of the first and second voltage dividers. Each voltage divider contains the series resistance $Rv_1$ and $Rv_2$ as well as a respective measurement resistance $Rm_1=1/G_1$ and $Rm_1=1/G_1$, which respectively correspond to the reciprocal $1/G_1$ and $1/G_2$ of a conductance $G_1$ and $G_2$ which can be determined by calculation. The measured analog AC voltage elements $u_1$ and $u_2$ are rectified and are temporarily stored in analog form in the S&H circuit as analog peak DC voltage values $\hat{U}_1$ and $\hat{U}_2$. The analog value is then in each case converted to a respective digital value $U_1$ and $U_2$, and these are temporarily stored in digital form in a memory. After this has been checked by the microprocessor, either a first and a second conductance and/or a corresponding first and second value of the specific electrical conductivity are/is determined by calculation. A comparison is then carried out with the digital basic tank value. Corresponding substeps have, however, not been illustrated in any more detail in FIG. 2. If the moisturizing storage device is insufficiently wetted with sealing liquid (for example water) in the lower area close to the flap, then a higher first power is required for operation of a pump, with this power being higher than a lower second power used to maintain the moisturized state.

A fifth checking step 115 is reached after a step 114. If the second conductance or second value of the specific electrical conductivity $X_2$ is less than the digital basic tank value $X_T$, then a jump is made to step 116, in which the pump is switched on, and its drive is set to a high, first power.

Otherwise, a check is carried out in a sixth checking step 117 to determine whether a first conductance or a first value of the specific electrical conductivity $X_1$ is less than the digital basic tank value $X_T$. In a situation such as this, a jump is made to step 118, in which the pump is switched on, and its drive is set to a low, second power. After steps 116 and 118, a jump is made back to the start of the routine in step 114, in which the values measured by the measurement cells are checked and processed.

Otherwise, if the first conductance or first value of the specific electrical conductivity $X_1$ is not less than the digital basic tank value $X_T$, then a check is carried out in a seventh checking step 119 to determine whether $X_1$ is in a tolerance band $0.98\ X_2<X_1<1.02\ X_2$. If this is the case, then the pump is switched off in a step 120. However, if this is not the case, then the process moves to an eighth checking step 121.

The eighth checking step 121 is used to check whether a first conductance or a first value of the specific electrical conductivity $X_1$ is less than the second conductance or second value of the electrical conductivity $X_2$. If this is the case, then a jump is made to step 122, in which the pump is switched on and its drive is set to a low, second power. After steps 120 and 122, a jump is made to a step 126, in which the moisturizing and sealing process for a letter envelope is enabled when the letter envelope flap passes the first sensor 2321. The pump is then operated for a defined time, which contributes to compensation for the loss of liquid in the moisturizing means during the moisturizing process. After step 126, a jump is made back to the start of the routine in step 114, in which the values measured by the measurement cells are checked and processed.

However, if it is found in the eighth checking step 121 that a first conductance or first value of the electrical conductivity $X_1$ is not less than the second conductance or second value of the electrical conductivity $X_2$, then the pump is switched off in step 123 and the jump is made to step 124, in order to repeat the tank sensor check. In this case, the same routine as in the third step 103 is carried out again, as has already been explained above. A jump is then made to a checking step 125 in order to repeat the check—as known from the third checking step 108.

If it is found in the checking step 125 that the digital basic tank value $X_T$ is less than the third digital comparison value C, with the latter being the lowest digital comparison value, then a jump is made to a final step 127 in order to emit a false message or to signal the end of the moisturizing process. Otherwise, a jump is made to step 126, in which the moisturizing and sealing process for a letter envelope is enabled.

Figure 3:
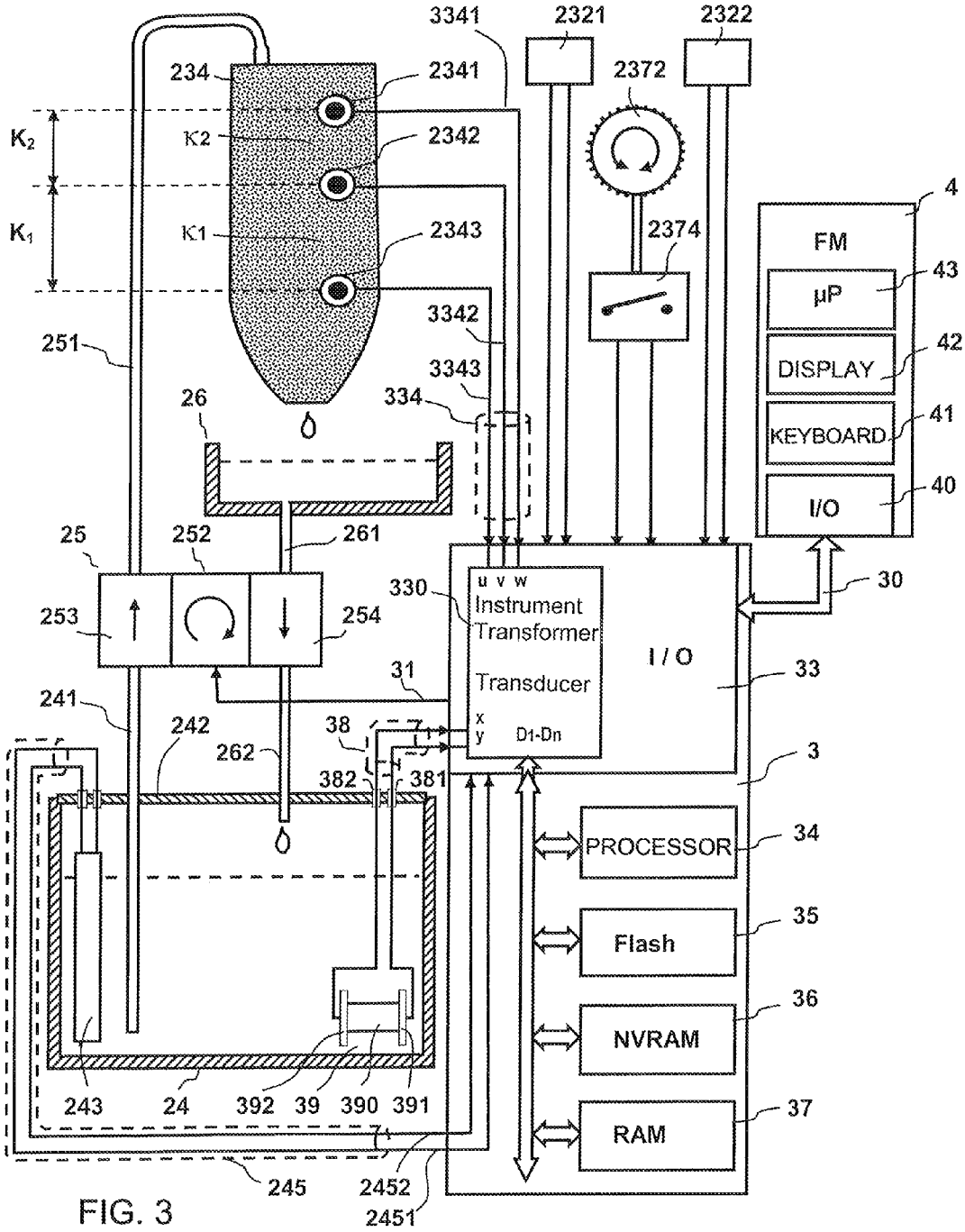
FIG. 3 is a diagrammatic, illustration of a configuration for dynamic control of the liquid supply to the moisturizing storage device for a moisturizing apparatus for application of sealing liquid to envelope flaps of letter envelopes, according to a second embodiment of the invention.

The dynamic control of the liquid supply to the moisturizing storage device for a moisturizing apparatus for application of sealing liquid to envelope flaps of letter envelopes, according to a second embodiment, will be explained with reference to FIG. 3. In comparison to the configuration shown in FIG. 1, a tank sensor 243 is also arranged in the tank 24, as is already known in principle from published, non-prosecuted German patent application DE 198 45 832 A1. The tank sensor 243 is connected to the input/output unit 33 via the electrical lines 2451, 2452 of the cable 245. When the liquid tank 24 is full, an appropriate signal can be supplied to the evaluation and control circuit 3 in order to distinguish whether the liquid tank 24 is empty or full. The signal is used to request the user to fill the tank, by an indication on the display. The rest of the configuration corresponds to that which has already been explained with reference to FIG. 1.

The two other electrodes 2343 and 2341 of the moisturizing storage device are connected to the measurement points u and w of the transducer 330, and are at their respective measurement potential. The electrode 2342 is connected to the measurement point v of the transducer 330 and is at ground potential. The two electrodes 2342 and 2343, as well as 2342 and 2341, respectively form a measurement cell for the electrical conductivity and are separated from one another by a respective height $K_1$ or $K_2$. The specific electrical conductivity $\kappa 1$, $\kappa 2$ is dependent on the nature of the sealing liquid.

Figure 4:
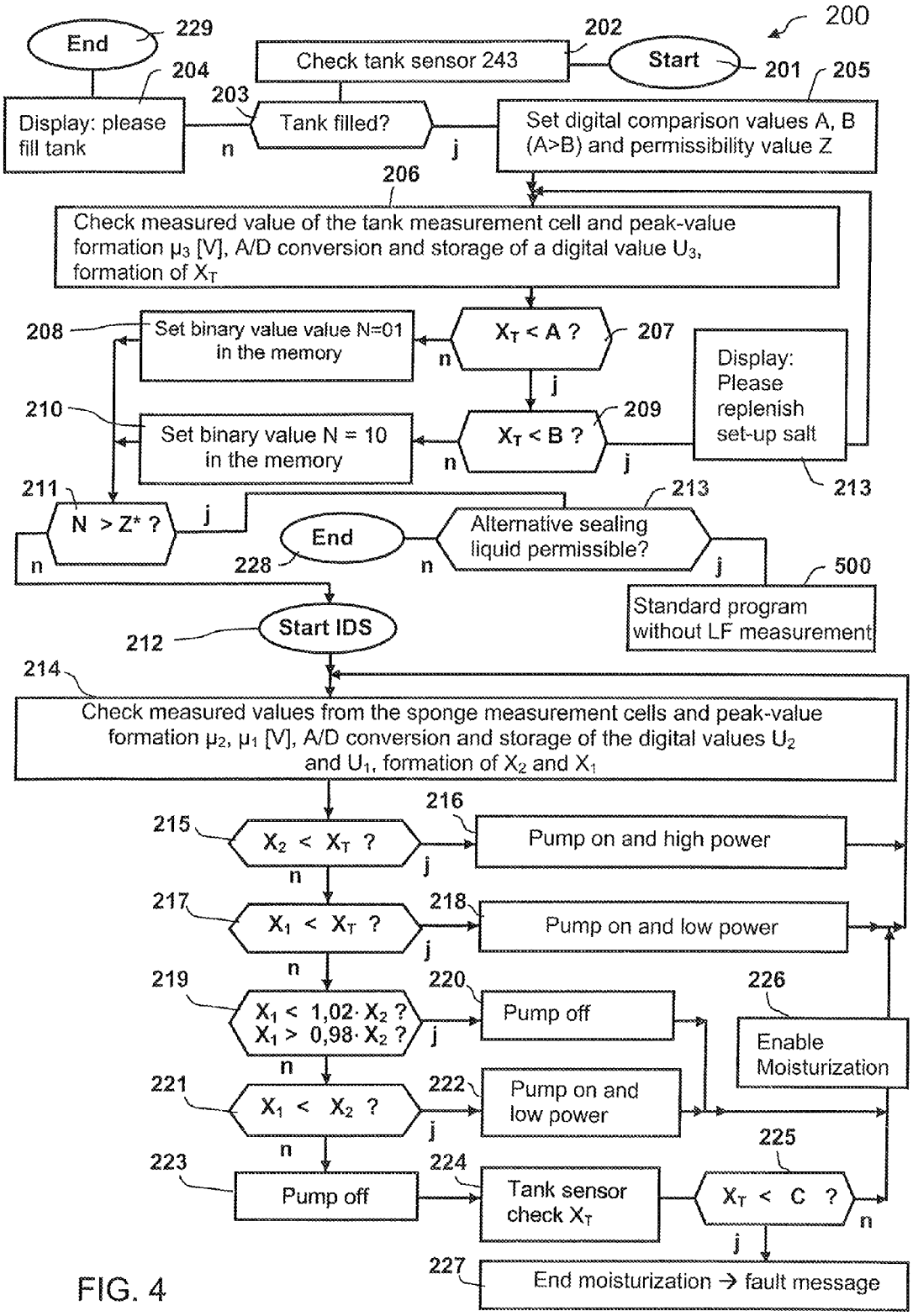
FIG. 4 is a flowchart illustrating a method for dynamic control of the liquid supply according to the second embodiment.

FIG. 4 shows a flowchart of a method for dynamic control of the liquid supply, according to the second embodiment. Once the method 200 has been started, for example (step 201), after the machine has been switched on, a second step 202 is reached, in order to check the tank sensor 243. The next, first checking step 203 is used to check whether the tank 24 is full. If the tank 24 is not full, then the display step 204 is reached, in order to request the user: "please fill the tank" or in order to signal the tank state. The end 229 is then reached. However, if the tank 24 is full, then the preparation step 205 is reached, in order to place digital comparison values A, B and a permissibility value Z* in a respective register. The digital comparison value A is higher than the digital comparison value B.

In the routine of the next, third step 206, a tank measurement cell 39 is checked, and in the process an analog AC voltage element u is sampled at the center tap of the third voltage divider. The measured analog AC voltage value u is rectified and is temporarily stored, in analog form, in the S&H circuit as the analog peak DC voltage value $\hat{U}_3$. The analog value is then converted to a digital value $U_3$, and is temporarily stored in digital form in a memory. After this has been checked by the microprocessor, a digital basic tank value $X_T$ is determined by calculation. The digital comparison values A and B are once again used for classification of the sealing liquid on the basis of its conductance or electrical conductivity. If it is then subsequently found in a second checking step 207 that the digital basic tank value $X_T$ is less than the first digital comparison value A, then a jump is made to a third checking step 209. Otherwise, if the digital basic tank value $X_T$ is not less than the digital comparison value A, then a jump is made to a step 208, and a first binary value N=01 is set in the memory in order to identify the first state found, that there is an electrically conductive sealing liquid in the tank.

In the third checking step 209, it is found that the digital basic tank value $X_T$ is less than the second digital comparison value B, with the latter being less than the higher digital comparison value A. This undershooting results in a jump to the display step 213 in order, for example, to signal to the user: "Please replenish set-up salt!". A jump is made back from the display step 213 to the start of the routine in step 206.

Otherwise, if the digital basic tank $X_T$ is not less than the second digital comparison value B, then a jump is made to step 210 and the second binary value N=10 is set in the memory, in order to identify the second state found, for example that there is drinking water or mains water in the tank.

A jump is made from the checking steps 207 and 209 to a fourth checking step 211. A check is carried out in the fourth checking step 211 to determine whether the state value N has exceeded the permissibility value Z*. If this is the case, then a check is carried out in a fifth checking step 213 to determine whether the use of an alternative sealing liquid is permissible. If this is the case, then a standard program 500 is run, without any conductivity measurements. Otherwise, if this is not the case, the end (step 228) is reached. If it is found in the fourth checking step 211 that the state value N has not exceeded the permissibility value Z*, then a start step 212 is reached for a routine for intelligent dynamic sealing liquid supply (IDS). The IDS routine includes the steps 212 to 227 and corresponds to the steps 112 to 127 of the IDS routine according to the first variant, which has already been explained with reference to FIG. 2.

Figure 5A:
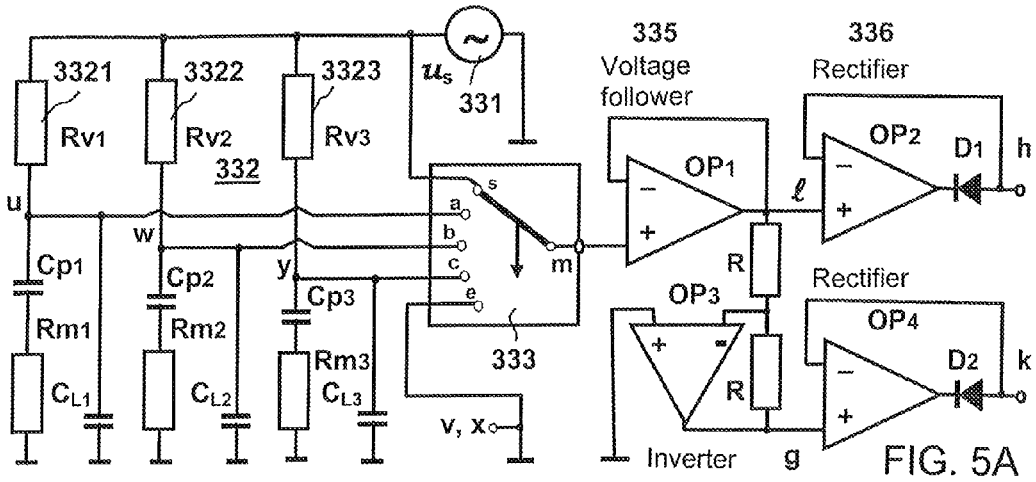
FIG. 5A is a schematic diagram of a first electronic circuit for a transducer.
Figure 5B:
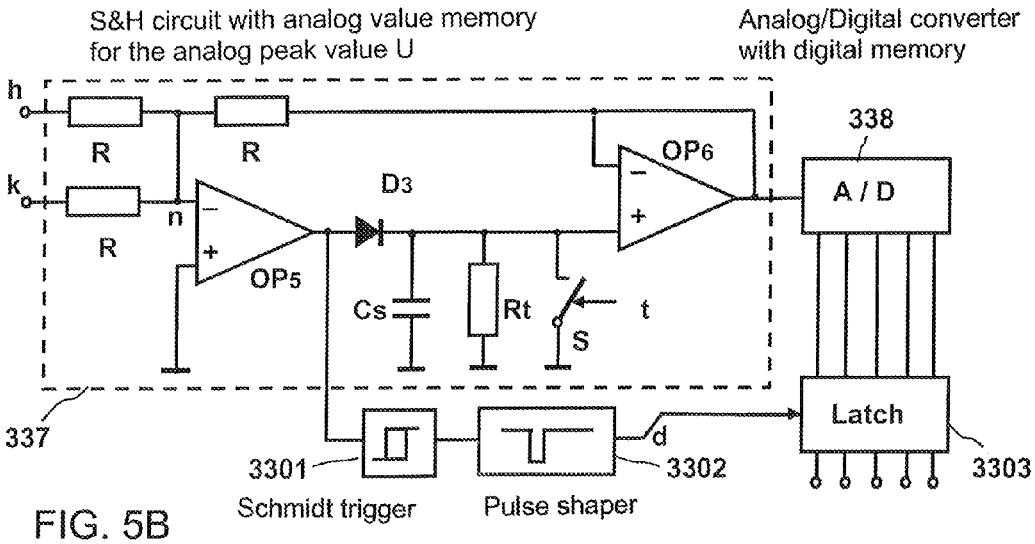
FIG. 5B is a schematic diagram of a second electronic circuit for the transducer.

FIGS. 5A and 5B show an electronic circuit of the transducer. The transducer part shown in FIG. 5A contains an AC voltage source 331, a measurement circuit 332 and a measurement changeover switch 333, which is followed by an impedance converter assembly 335 and a rectifier assembly 336. The AC voltage can easily be derived from the mains voltage. The AC voltage source 331 is, for example, a mains transformer.

The measurement circuit 332 contains three voltage dividers, whose respective series resistances $R_{v1}$, $R_{v2}$ and $R_{v3}$ are connected on one side to one pole of the AC voltage source 331 and on the other side to the measurement points u, v and w of the measurement circuit 330. The voltage divider taps correspond to the abovementioned measurement points.

The measurement cells, whose electrical equivalent circuits have been illustrated, are located between each tap and ground potential. The respective reciprocal of the conductance corresponds to a resistance $R_{m1}$, $R_{m2}$ and $R_{m3}$ of the liquid in each measurement cell. A capacitance $C_{p1}$, $C_{p2}$ and $C_{p3}$ is in each case connected in series with them in order to simulate the polarity processes in the liquid. A respective line capacitance $C_{L1}$, $C_{L2}$ and $C_{L3}$ of the lines in the cables 334 and 38 (FIG. 3) is in each case connected in parallel with this RC series circuit. The voltage divider taps are connected to the measurement changeover switch 333, to whose output m the non-inverting input of a first operational amplifier OP1, which is connected as a voltage follower, is connected. The configuration of the measurement changeover switch 333 will be explained further below with reference to FIG. 7. The output l of the first operational amplifier OP1 in the impedance converter assembly 335 is electrically conductively connected to the non-inverting input of a second operational amplifier OP2 and, via a resistance R, to the inverting input of a third operational amplifier OP3 in the impedance converter assembly 335. The third operational amplifier OP3 is connected as an inverter, and has an output g.

The first and third operational amplifiers OP3 are a component of an impedance converter assembly 335 with an inverting output g and a non-inverting output l, which are each followed by precision rectifiers. The precision rectifiers are part of a rectifier assembly 336 and each contain an operational amplifier OP2 and OP4 with a respective diode D1, D2 in the negative feedback path, which produces a connection from the output to the inverting input of the respective operational amplifier. For example, if the output of the operational amplifier OP2 and OP4, respectively, is connected to the n-region of the respective diode D1, D2, then the p-region of the respective diode D1, D2 forms a respective output h or k. The respective other non-inverting input of the respective operational amplifier OP2 or OP4 is electrically conductively connected to the output l of the first operational amplifier OP1 or, respectively, to the output g of the third operational amplifier OP3.

The transducer part shown in FIG. 5B includes a sample and hold circuit 337 with an analog value memory Cs for an analog DC voltage peak value $\hat{U}$, and an analog/digital converter 338 with a digital memory (latch). The analog value memory Cs is a capacitor, which can be discharged by a controllable switch S before the measurement. The latter is preferably an electronic switch, which can be controlled by the microprocessor. The capacitor is charged via a diode D3 to a positive peak voltage, which is emitted on the output side of a fifth operational amplifier OP5 when a negative input current flows into the node n at the inverted input of the fifth operational amplifier OP5. This is the situation as soon as one of the two precision rectifiers in the rectifier assembly 336 emits a negative DC voltage at its outputs h and k. The latter is converted to the negative input current via the resistances R at the input of the S&H circuit. The positive peak voltage emitted on the output side of the fifth operational amplifier OP5 is also applied to the non-inverting input of a sixth operational amplifier OP6, which is connected as a voltage follower and whose output is connected on the one hand to the analog input of an A/D converter 338, and on the other hand via a resistance R to the node n. The AD converter 338 converts the analog peak voltage $\hat{u}$ to a digital value U. If the voltage amplitude at the input of the S&H circuit decreases, the operational amplifier switches over and emits a negative output voltage, for which the diode D3 is reverse-biased. A Schmidt trigger 3301 and a downstream pulse shaper 3302 produce a handover signal at the output d to a latch 3303 for data transfer of the digital value U. The transducer 330 is a component of an input/output circuit 33, which is connected via a bus to the micro-processor for data, control and address purposes.

Figure 6:
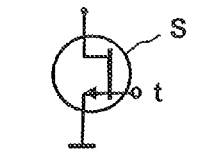
FIG. 6 is a schematic diagram of an electronic switch.

FIG. 6 shows a field-effect transistor FET as the electronic switch S which can be driven by the microprocessor at the time t in order to discharge the capacitor Cs and to start a new measurement process.

Figure 7:
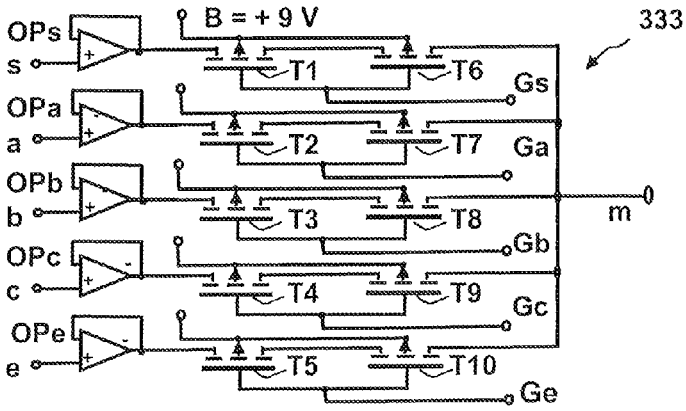
FIG. 7 is a schematic diagram of an electronic circuit of an analog multiplexer.

FIG. 7 shows an analog multiplexer 333 containing input-side operational amplifiers OPa, OPb, OPc, . . . , OPe and OPs, which are connected as voltage followers, and downstream electronic switches T1 to Tn, which are electrically connected at the signal output. The electronic switches are preferably p-channel MOSFETs of the enhancement type. The drain-source resistance RDS can be controlled by the gate-source voltage UGS between:

$$R_{DS}=R_{off}\approx 10^{10}\Omega \text{ when } U_{GS}=0\text{ V}$$

and $$R_{DS}=R_{on}\approx 30\Omega \text{ when } -U_{GS}=20\text{ V}.$$

For example, if an AC voltage is applied to the voltage divider and has a peak voltage $\hat{u}_c$ at the tap c. This is applied by the input-side operational amplifier OPc to the drain connection of the MOSFET. A positive voltage $U_B$=+9 V is applied to a separate bulk connection B, in order to prevent the pn-junction between the source S and the bulk B being switched on when the input voltages $\hat{u}_c$ are positive. A control voltage $U_{GS}$ is applied via the respective gate, for example Gc, via a drive circuit, which is not shown but is itself driven by the microprocessor in order to operate the respective MOSFET switch.

Figure 8A:
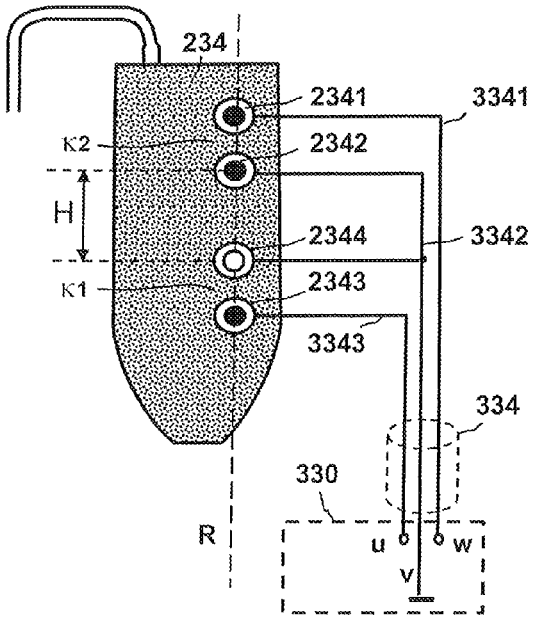
FIG. 8A is a diagrammatic, illustration of the moisturizing storage device for the moisturizing apparatus with a total of four electrodes in a row.

FIG. 8A shows the moisturizing storage device 234 of a moisturizing apparatus having a total of four electrodes, which are arranged one above the other in a row on a mounting board—which is concealed by the moisturizing storage device—of a holding compartment of the blade. The electrodes are, for example, in the form of electrically highly conductive hollow cylinders, which project through a respective hole in the moisturizing storage device 234. The outer surface of the hollow cylinder is preferably gold-plated. The hollow cylinder of the electrode 2344 is filled internally with plastic. The hollow cylinders of the other electrodes 2341 to 2343 are open or are filled with plastic internally, with an opening (black) being incorporated in each of them. The openings are used for attachment of a holding plate, which is not shown. During operation, the first and the last electrode in the row are at a measurable voltage potential. The central two electrodes 2342 and 2344 are at ground potential and are separated from one another by a height H. The distances between the electrodes of a measurement cell, that is to say between the first and third electrode 2341 and 2343, respectively, and the associated second electrode 2342 and fourth electrode 2344, to which ground potential is applied, are less than the height H. The first and third electrodes together with the respectively associated electrodes 2342 and 2344 to which ground potential is applied each form a measurement cell for measurement of the specific electrical conductivity κ2 or κ1, respectively, of the sealing liquid between the electrodes. The respective first and third electrodes 2341 and 2343 are connected via a respective line 3341 and 3343 to the measurement points u and w, respectively, of the transducer 330. The respective second and fourth electrodes 2342 and 2344 are connected to a line 3342, which is at ground potential, produced by the transducer 330 at the point v. The lines 3341, 3342 and 3343 are passed to the transducer 330 within a cable 334.

Figure 8B:
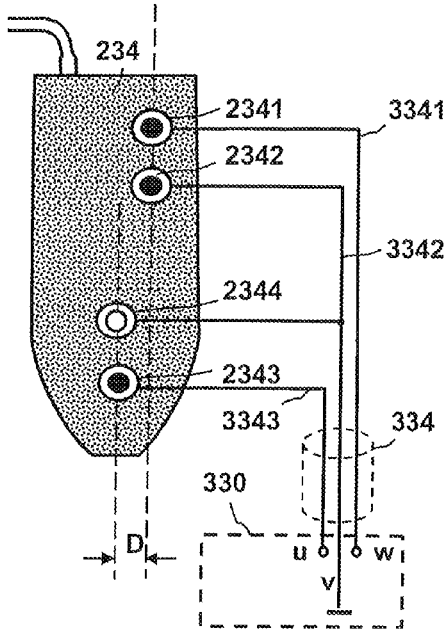
FIG. 8B is a diagrammatic, illustration of the moisturizing storage device for the moisturizing apparatus with a total of four electrodes in two rows offset with respect to one another.

FIG. 8B shows the moisturizing storage device 234 for the moisturizing apparatus having a total of four electrodes, which are arranged in two rows which are offset with respect to one another. The offset D in the surface of the moisturizing storage device 234 is admittedly in this case of the same order of magnitude as the distance between two electrodes of one measurement cell. However, this is not intended to prevent anyone from arranging the electrodes in a different suitable position, on the basis of experience, in the surface of the moisturizing storage device or differently fitted measurement cells, as the suitable measurement cells. The four electrodes 2341 to 2344 are once again electrically connected to the transducer 330 via lines 3341 to 3343, as has already been explained with reference to FIG. 8A.

Figure 8C:
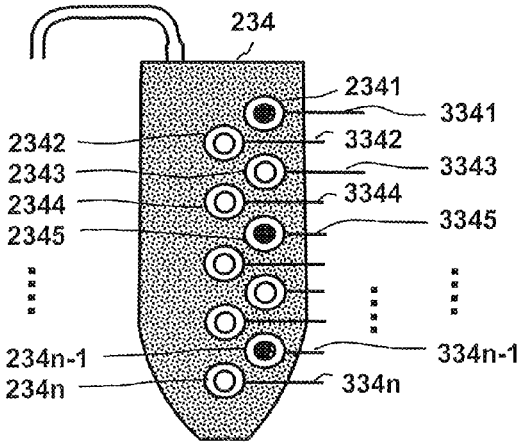
FIG. 8C is a diagrammatic, illustration of the moisturizing storage device for the moisturizing apparatus with a multiplicity of electrodes distributed over an area.

FIG. 8C shows a moisturizing storage device for the moisturizing apparatus having a multiplicity of electrodes, which are arranged offset with respect to one another in the surface. The electrodes 2341 to 234*n* are connected via lines 3341 to 334*n*—in a manner that is not illustrated—to the transducer, which is connected to the microprocessor during operation, in order to determine the liquid distribution in the moisturizing storage device of the moisturizing apparatus.

Figure 8D:
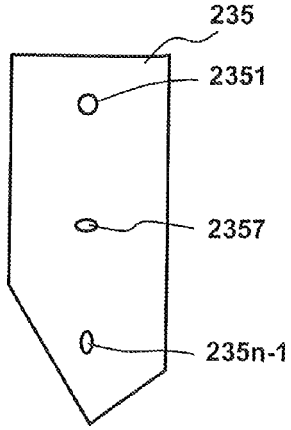
FIG. 8D is a diagrammatic, plan view of a holding plate for holding the moisturizing storage device.

FIG. 8D shows a holding plate for holding the moisturizing storage device, in the form of a plan view of the side facing the moisturizing storage device. The holding plate is, for example, produced from plastic. Holding bodies 2351 to 235*n*−1 which project vertically in a conical shape from the surface of the holding plate 235 are used for attachment of the holding plate 235 to the hollow cylinders. The base of the holding bodies 2351 to 235*n*−1, which stands on the surface of the holding plate 235, is in each case appropriately differently shaped in order to compensate for tolerance-dependent discrepancies in the position of the holding bodies with respect to the positions of the openings (black). By way of example, the openings are holes which are drilled or stamped into the plastic filling of the hollow cylinders, and whose shape is matched to that of the holding bodies.

Figure 9:
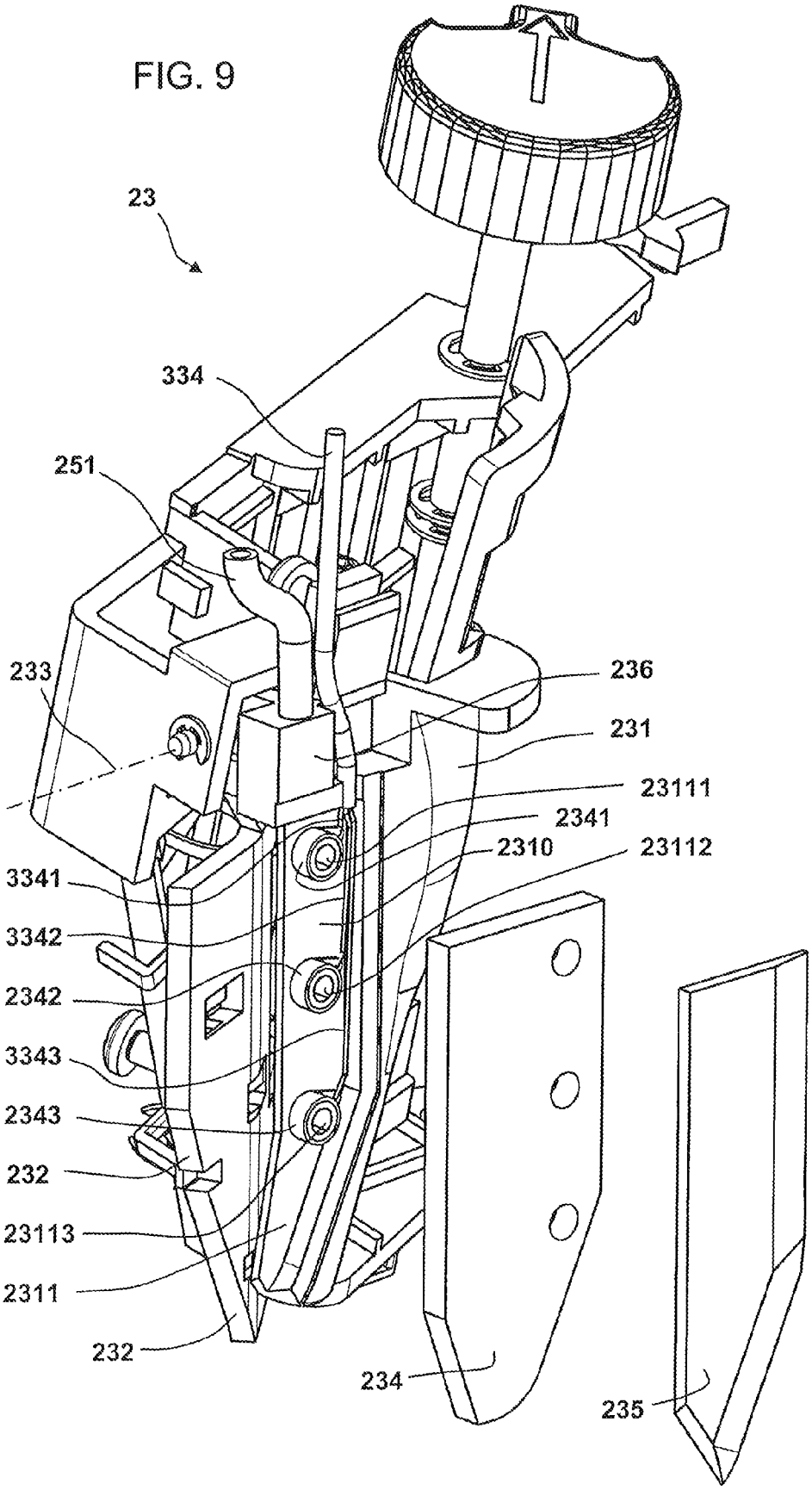
FIG. 9 is a diagrammatic, exploded perspective view of a guide unit for an envelope flap from the top left at the rear, and with a holder for the moisturizing storage device.

FIG. 9 shows a guide unit 23 for an envelope flap in the form of a perspective illustration from the rear at the top on the left and with a holder for the moisturizing storage device 234, in the form of an exploded illustration. The holder includes a compartment 2311, which is incorporated on that edge of the blade 231 which points downstream in the direction of the post, for holding the moisturizing storage device, and the abovementioned holding plate 235. The compartment 2311 is open towards that side which faces away from the envelope flap, and can be closed by plugging on the holding plate 235.

The visible side of the holding plate 235, which faces away from the moisturizing storage device, has curved areas which merge smoothly into the corresponding curved areas on the blade 231 when the holding plate 235 is plugged on. The lines 3341, 3342 and 3343 are carried within a cable 334, outside the blade. The exploded illustration allows the abovementioned mounting panel 2310 to be seen within the compartment 2311. The lines 3341, 3342 and 3343 are guided on the mounting panel 2310 within the compartment 2311 and are electrically conductively connected to the three electrodes 2341, 2342 and 2343. The three electrodes are in the form of outer hollow cylinders which, in the present example, are arranged horizontally in a row and are separated from one another by equal distances. An inner hollow cylinder 23111, 23112 and 23113 is in each case arranged in the outer hollow cylinder, and is mechanically connected to the mounting board 2310. The moisturizing storage device 234 is, for example, a sponge, and the sealing liquid is normal mains water. The blade 231 is used to raise the flaps, to hold the sponge and for mechanical attachment of the electrodes which are provided for measurement of the electrical conductivity. A flexible tube connecting piece 236, onto which the flexible supply tube 251 for the sealing liquid is plugged, is arranged close to the rotation axis 233 of the blade.

Alternatively, the electrodes 2341, 2343 may be in the form of annular electrodes, with the holding plate 235 being in the form of an opposing electrode. The holding plate 235 is at a defined distance from the annular electrodes and is attached to the compartment 2311, for example by at least one screw. The holding plate may be made from a metal plate, with which electrical contact is made via the electrode and a metallic inner hollow cylinder 23112.

Figure 10:
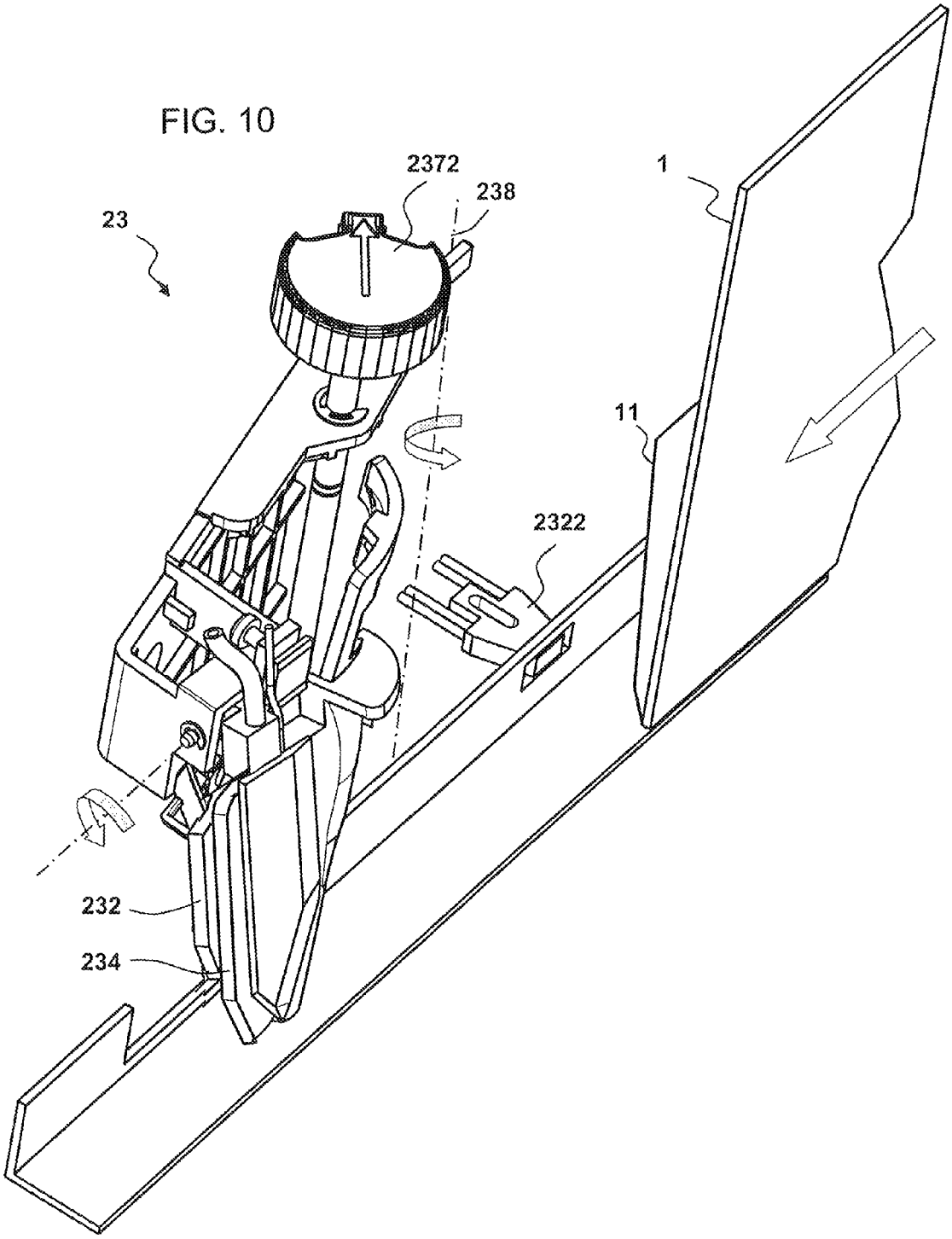
FIG. 10 is a diagrammatic, top-left, rear perspective view of a configuration of the guide unit for an envelope flap in the working position.

FIG. 10 shows a configuration of the guide unit 23 for an envelope flap in the working position, in the form of a perspective view from the rear, at the left on top. An envelope arriving in the direction of the post flow is transported in the direction of the arrow, is detected by the envelope sensor 2322, and the IDS program is started. When an unsealed envelope is transported along the guide unit 23, then the envelope flap 11 is first of all guided between a guide plate 232 and the concealed rear plate of the mounting panel 2310, and, after this, between the guide plate 232 and that side which is concealed here of the moisturizing storage device 234, which has been plugged onto the hollow cylinders. During the process, the gum on the inside of the envelope flap 11 is wetted with sealing liquid. The guide unit 23 can be pivoted by an operating lever 2372 about an axis 238 to the working position.

Figure 11:
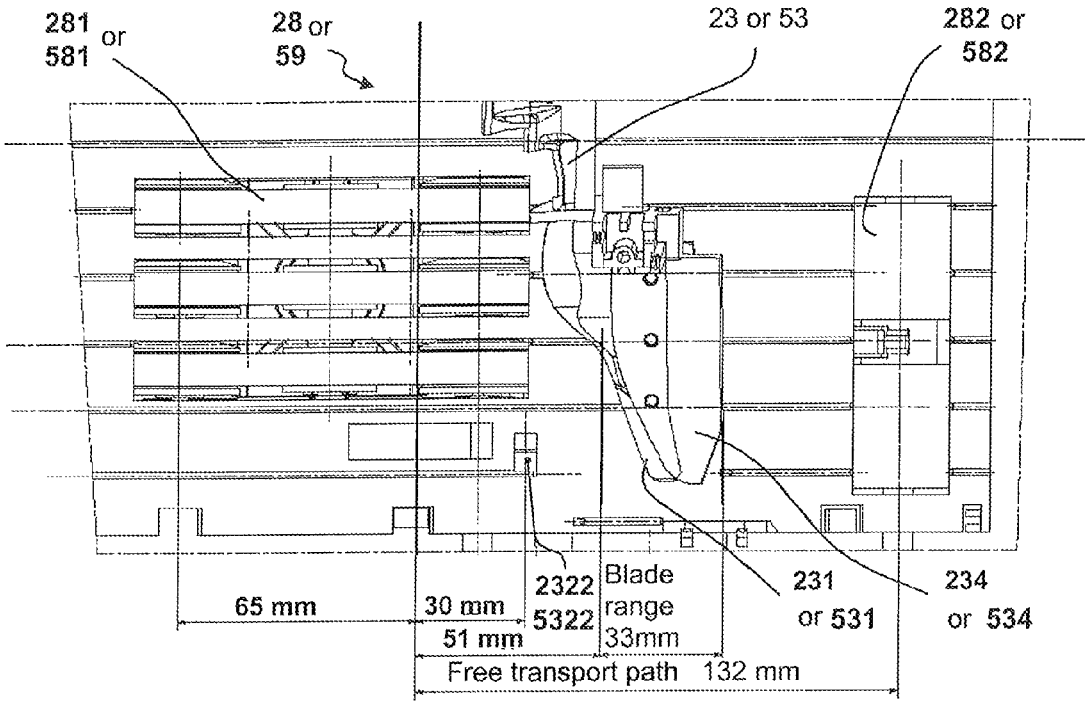
FIG. 11 is a diagrammatic, front view of the guide unit for an envelope flap in the working position.

The guide unit will be explained, in the working position, on the basis of a schematic front view of the guide unit for envelope flaps (FIG. 11). A known automatic feed station for separation of the items of post in a franking system is configured so as to produce a continuous flow of letter envelopes. One letter envelope follows the other without any gaps. The speed of the feed mechanism 281 (581) is less than that of the ejection roller 282 (582). After leaving the automatic feed station, with the items of post to be separated, the speed difference results in a gap before the next letter envelope. The gap increases with the transport distance, and has a magnitude of about 30 mm on leaving the ejection roller. The guide unit 23 for the moisturizing mechanism is, for example, arranged between the drive mechanism 281 for the separating section 28 and the ejection roller 282 for the separating apparatus 2, and has an envelope sensor 2322. The moisturizing mechanism contains the moisturizing storage device 234 and a blade 231. The blade is arranged in the flow of postal items (letter envelopes) (basic position). The front edge of the blade opens the envelope flap. The flap which has thus been separated from the envelope follows a contour of the guide unit 23, which guides the flap past the moisturizing storage device. The blade 231 is arranged such that it can move on the guide unit 23, in order to allow matching to the thickness of a filled envelope. After being moisturized by the moisturizing storage device (sponge), the flap which has now been moistened is placed on the letter envelope and is pressed against the letter envelope as it passes through the ejection roller. In the case of an automatic feed station for separation of the postal items and with a moistening mechanism, the gap between the letter envelopes is only about 12 mm in the moistening area. This is sometimes a result of a subsequent letter envelope entering the blade before the previous letter envelope has left it. At this time, the blade 231 is not in its basic position, that is to say with its front edge close to the letter running surface. The blade does not slide as desired along the front edge of the letter, which results either in the flap not being separated or in the letter envelope striking against the blade. In the first case, this leads to a flap sensor fault, and in the second case can lead to postal items becoming jammed. A further improved solution variant, in which the separation and transportation of the envelopes in the previous automatic feed station can remain essentially unchanged, uses a separate moisturizing module 5. The only difference is that the blade together with the moisturizing mechanism is removed from the area of the automatic feed station (AZ), and is arranged behind the latter, in the separate moisturizing module 5. The guide unit 53 for the moisturizing mechanism is arranged between the drive mechanism 581 of a supply section 59 and an ejection roller 592, and has an envelope sensor 5322. All of the components of the moisturizing unit, containing the blade 531 together with the sponge 534, and the components which are not shown, containing the water tank, the pump and the control system are accommodated in the separate module. In principle, the configuration of the components with respect to the flow of post remains unchanged.

Figure 12:
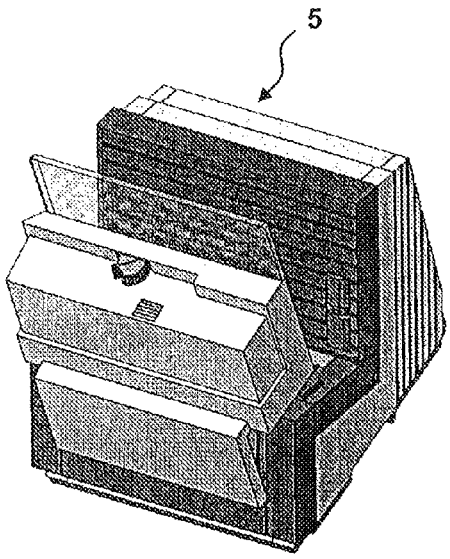
FIG. 12 is a diagrammatic, perspective illustration of a moisturizing module with the transport path open.

FIG. 12 shows an illustration of a moisturizing module with the transport path open, in the form of a perspective view from the front, from the right at the top. The additional module is arranged downstream in the postal flow from the automatic feed station, with the postal items being separated. The separation process separates the letter envelopes and, in this case, these are then drawn apart from one another by the ejection roller to form a gap of about 30 mm. The letter envelopes are passed, separated in this way, to the separate module, and their flaps are moistened. The letter transport in the separate module is configured in such a way that the flap is not stopped during the flap finding process. This is a major difference from the transport mechanism of the already known automatic feed station with separation. The use of the separate module is also advantageously possible for existing jet-mail franking systems, and makes it easier for the blade to find the flaps, even though existing components are still used. A further advantage is the reduction in any jam in the blade area, since the greater gap allows better thickness compensation. If the postal items become jammed, the transport path of the module can be opened.

Figure 13:
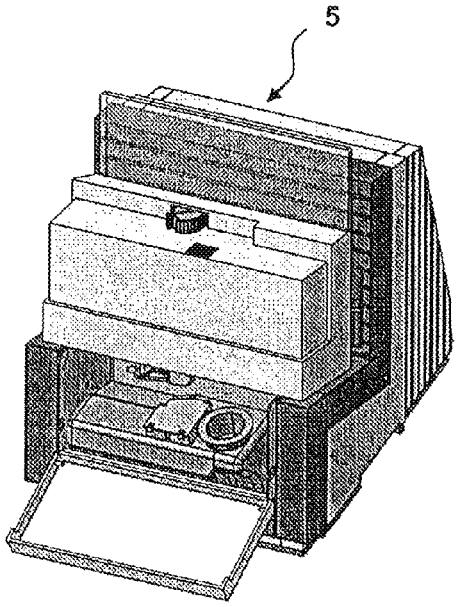
FIG. 13 is a diagrammatic, perspective illustration of a moisturizing module with the tank access open.

FIG. 13 shows an illustration of a moisturizing module with an open tank access, in the form of a perspective view from the front, from the right at the top.

Figure 14:
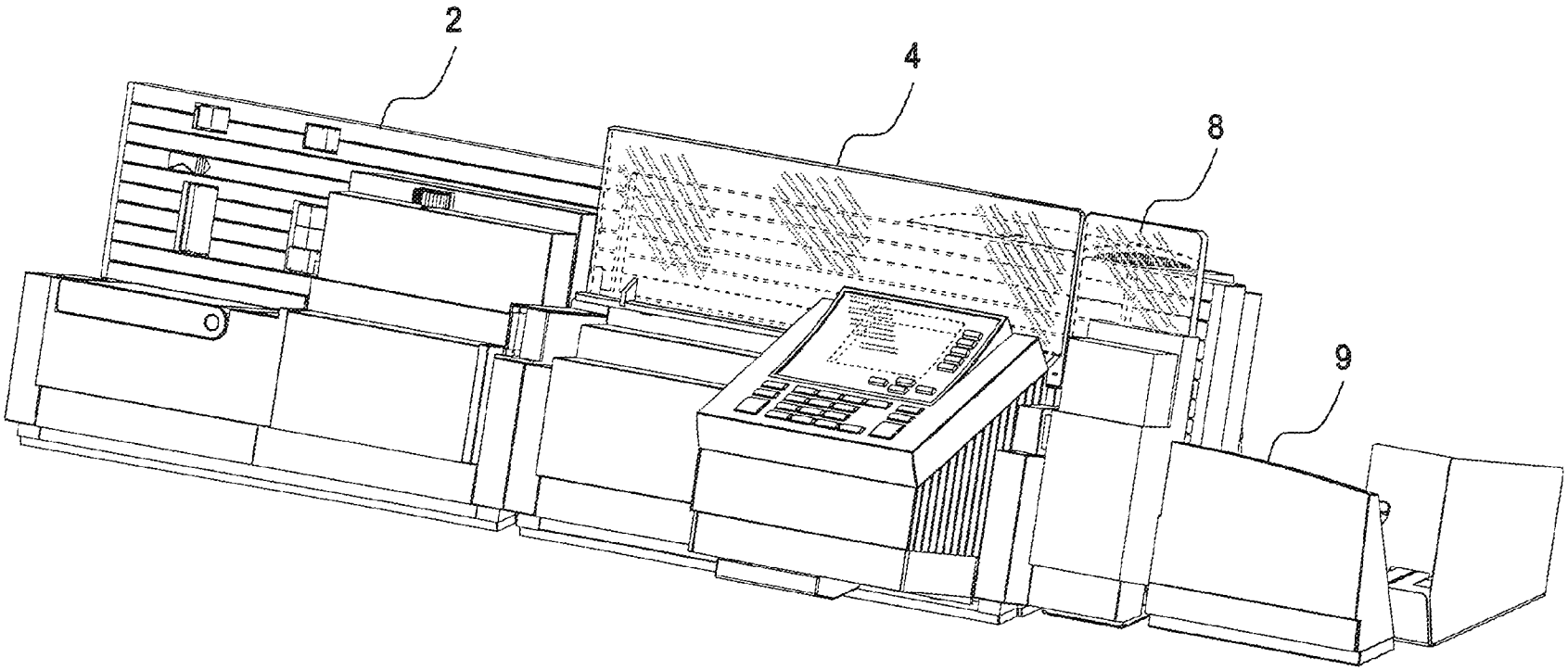
FIG. 14 is a diagrammatic, perspective illustration of a franking system containing an improved known automatic separating and supply station with optional moisturizing of the letter flaps, containing the franking machine with the franking strip transmitter, the power sealer station and a letter store.

FIG. 14 shows a franking system containing an improved known automatic separation and feed station 2 with optional moistening of the letter flap, a franking machine 4 with a franking strip sensor, a power sealer station 8 and a letter store 9, in the form of a perspective illustration. The improvement is achieved by the configuration of electrodes, the electrical conductivity measurement and moistening control technique, and with the aid of a routine for intelligent dynamic sealing liquid supply (IDS).

Figure 15:
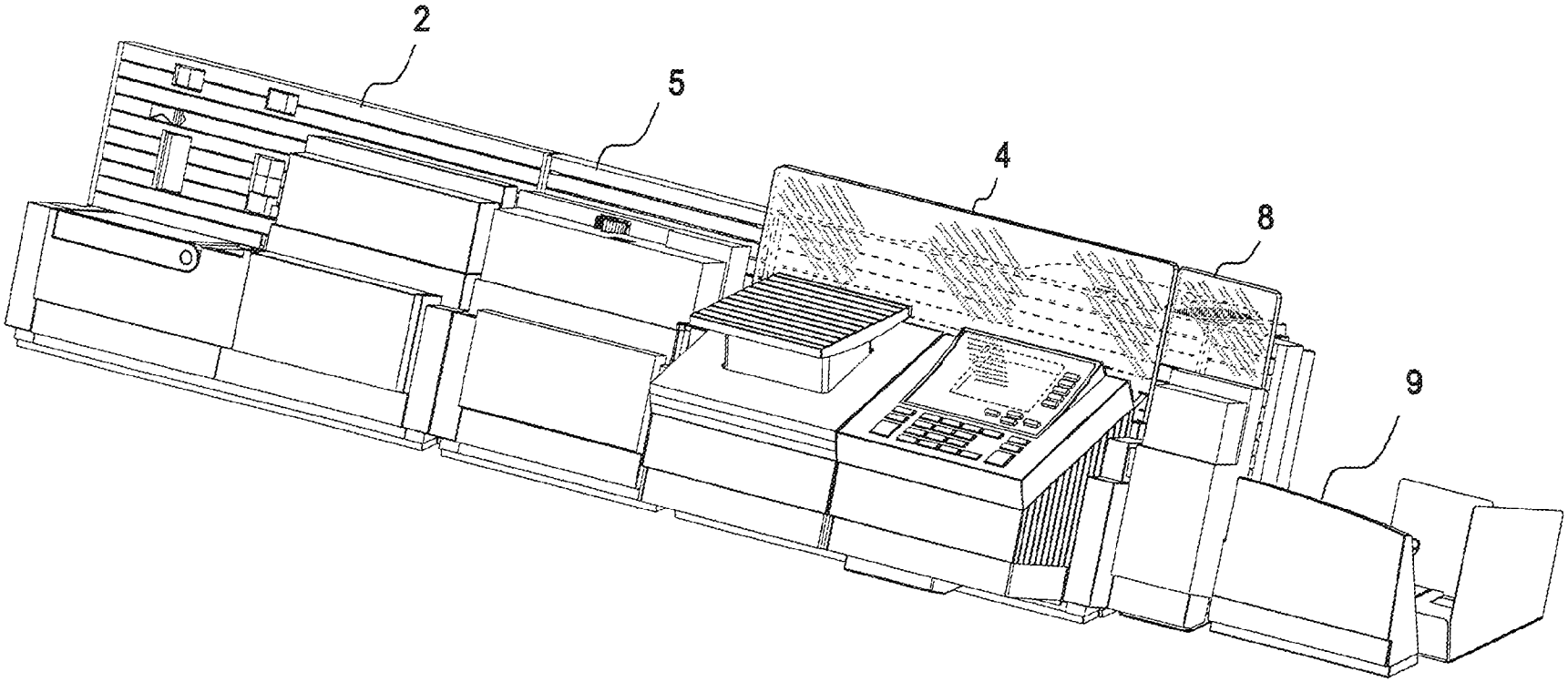
FIG. 15 is a diagrammatic, perspective illustration of a franking system containing an improved known automatic supply station with the postage items being separated, containing a moisturizer station, the franking machine with the franking strip transmitter and integrated static scale, as well as the power sealer station and the letter store.

FIG. 15 shows a franking system containing an improved, known automatic feed station 2 with separation of the postal items, a separate moistener station 5, the franking machine 4 with the franking strip sensor and an integrated static scale, as well as the power sealer station 8 and the letter store 9, in the form of a perspective illustration. The improvement is achieved by the configuration, as used in the separate moistener station 5, for dynamic control of the liquid supply to a moisturizing storage device and the IDS method.

Figure 16:
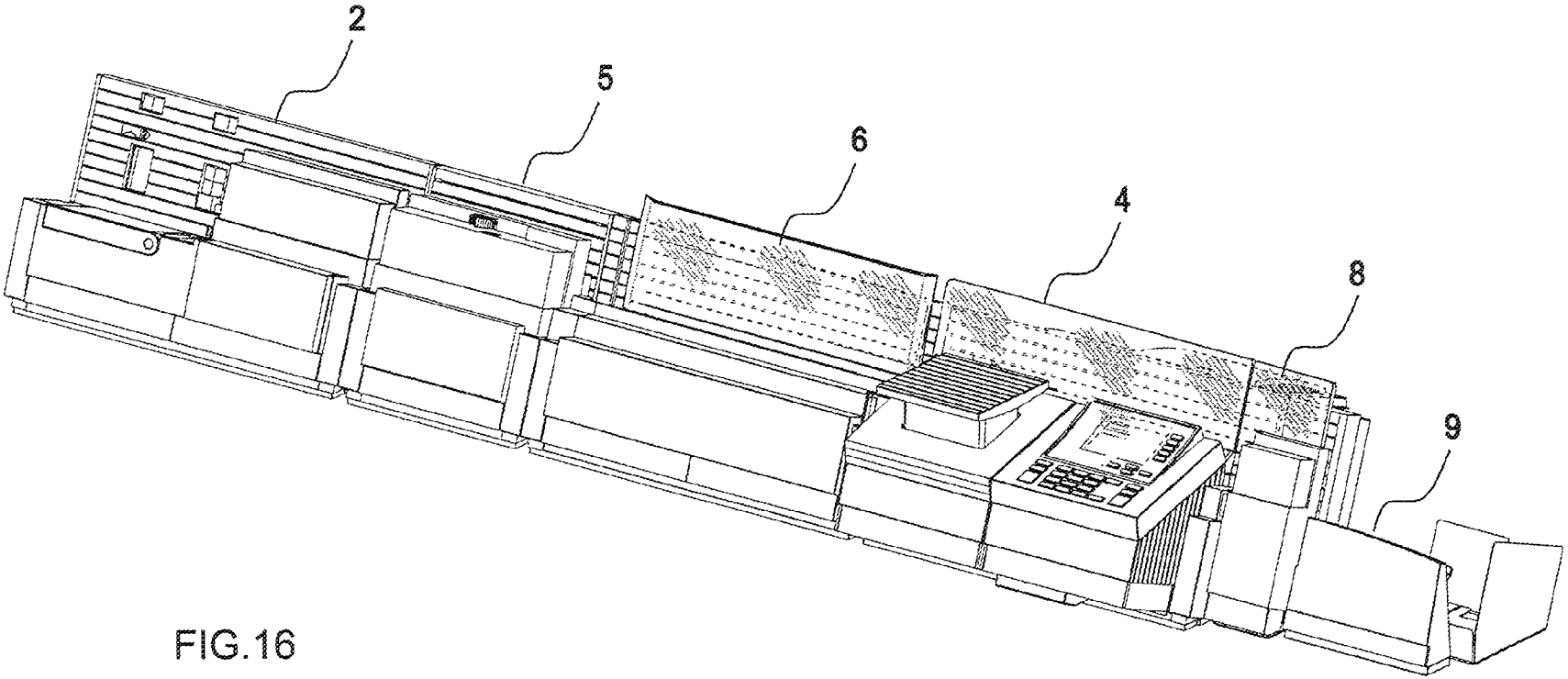
FIG. 16 is a diagrammatic, perspective illustration of a franking system containing an improved known automatic supply station with the postage items being separated, containing a moisturizer station, containing a dynamic weighing station, the franking machine with the franking strip transmitter and integrated static scale, as well as the power sealer station and the letter store.

FIG. 16 shows a franking system containing an improved known automatic feed station 2 with separation of the postal items, a moistener station 5, a dynamic weighing station 6, the franking machine 4 with the franking strip sensor and the integrated static scale, as well as the power sealer station 8 and the letter store 9, in the form of a perspective illustration. The improvement is likewise achieved by the configuration, as used in the separate moistener station 5, for dynamic control of the liquid supply to a moisturizing storage device, and the IDS method.

The conductivity measurement in step 103 or 206 includes formation of the basic tank value $X_T$ and can in this case take into account a correction factor for compensation of measured value discrepancies resulting from temperature fluctuations and production tolerances. The classification of the sealing liquid in steps 104 to 109 or 208 to 209 can also be carried out in a manner other than that shown in FIGS. 2 and 4, that is to say by checking on the basis of ≧ instead of <, in which case the responses are no (or yes) negated to yes (or no).

Where the abovementioned example refers to an indirect measurement of the amount of liquid stored in the moisturizing storage device, in particular by conductivity measurement, then this is not intended to preclude other forms of indirect measurements of physical or chemical parameters which can be used instead of or in addition to conductivity measurement. For example, the sealing liquid that is being used can likewise be identified, or the accuracy of the identification of the sealing liquid that has been used can be increased, by measuring the weight of the amount of liquid stored in the moisturizing storage device.

The invention claimed is:

1. A configuration for dynamic control of a liquid supply to a moisturizing storage device for a moisturizing apparatus for application of a sealing liquid to envelope flaps of letter envelopes and having a tank for storing the sealing liquid, the configuration comprising:

a pump for supplying the moisturizing storage device with the sealing liquid from the tank;

an evaluation and control circuit;

at least one sensor electrically connected to said evaluation and control circuit and disposed in an area of the moisturizing storage device in a movement path of the envelope flaps, said sensor producing a signal to initiate said pump when an envelope flap passes said sensor;

electrodes connected during operation to said evaluation and control circuit, said electrodes including:

device electrodes disposed in the moisturizing storage device and forming at least first and second measurement cells, and tank electrodes defining a third measurement cell disposed in said tank;

said evaluation and control circuit programmed to:

on wetting of said tank electrodes of said third measurement cell by the sealing liquid, measure a resistance measured value of the sealing liquid stored in the tank of the moisturizing apparatus;

perform a subsequent qualitative analysis for determining a nature of the sealing liquid used on a basis of at least one of a determined electrical conductance and a determined specific electrical conductivity and at least one corresponding material parameter functioning as a comparison value;

carry out measurements of further resistance measured values corresponding to an amount of the sealing liquid stored in the moisturizing storage device; and carry out dynamic control of the liquid supply to the moisturizing storage device in dependence on the corresponding material parameter and of at least one of a conductance determined from the further resistance measured values or a corresponding value of a specific electrical conductivity determined during the measurements of the amount of the sealing liquid stored in the moisturizing storage device.

2. The configuration according to claim 1, wherein said evaluation and control circuit has an input/output unit with a transducer electrically connected to said electrodes.

3. The configuration according to claim 1, wherein said evaluation and control circuit has a transducer and an input/output unit electrically connected to said electrodes through said transducer.

4. The configuration according to claim 3, wherein said evaluation and control circuit includes:

a driver circuit for at least one of switching on and controlling said transducer; and a microprocessor bus connected to said driver circuit.

5. The configuration according to claim 1, wherein the moisturizing storage device is composed of a material selected from the group consisting of open-cell foams, felts and non-wovens and has openings formed therein in which said electrodes are disposed.

6. The configuration according to claim 2, further comprising a cable having electrical lines connecting said electrodes to said transducer.

7. The configuration according to claim 2, further comprising a first cable and a second cable electrically connecting said electrodes to said transducer, said first and second cables each having a low cable capacitance.

8. The configuration according to claim 2, wherein three of said electrodes are disposed in a row in the moisturizing storage device.

9. The configuration according to claim 2, wherein said device electrodes are disposed in the moisturizing storage device in two rows offset with respect to one another.

10. The configuration according to claim 2, wherein a multiplicity of said electrodes are disposed offset with respect to one another in a surface of the moisturizing storage device.

11. The configuration according to claim 2, wherein said transducer has a measurement circuit and an AC voltage source;

further comprising electrical lines connecting said device electrodes disposed in the moisturizing storage device, defining said first and said second measurement cell, to said measurement circuit;

wherein said measurement circuit together with said first and second measurement cells define voltage dividers, said voltage dividers include a first voltage divider having a first series resistance connected in series with a first resistance resulting from a first specific electrical conductivity of the sealing liquid and of geometric dimensions of the first measurement cell, and a second voltage divider having a second series resistance connected in series with a second resistance resulting from a second specific electrical conductivity of the sealing liquid and geometric dimensions of the second measurement cell, as a result of wetting of the moisturizing storage device with the sealing liquid at mutually opposite points; and wherein said AC voltage source is connected within said transducer via said first and second series resistances.

12. The configuration according to claim 11, wherein said AC voltage source produces a balanced AC voltage with an undefined waveform at a frequency in a range from 50-120 Hz.

13. The configuration according to claim 11, wherein:

said transducer has a changeover switch with a switching means, a main contact, an output and input contacts;

said transducer has an impedance converter, a precision rectifier, a sample and hold circuit, and an analog/digital converter; and each of said voltage dividers within said transducer has a center tap electrically conductively connected to in each case to one of said input contacts of said changeover switch, and can be connected via said switching means to said main contact of said changeover switch for measuring a measurement voltage at said center tap of said first voltage divider, with said main contact at said output of said changeover switch being connected via said impedance converter, said precision rectifier and said sample and hold circuit to said analog/digital converter.

14. The configuration according to claim 13, wherein:

said evaluation and control circuit has a microprocessor; and said changeover switch has electronically controllable switches to form an analog multiplexer and, for control purposes, is connected to said microprocessor of said evaluation and control circuit.

15. The configuration according to claim 2, further comprising an insulated double line;

wherein said transducer has connecting terminals;

wherein said third measurement cell is attached internally to a closure piece of the tank, said third measurement cell electrically connected via said insulated double line to said connecting terminals of said transducer of said input/output unit of said evaluation and control circuit, said evaluation and control circuit allowing an electric alternating current to flow via said electrodes through the sealing liquid and evaluates a voltage drop;

wherein said evaluation and control circuit has a bus, a microprocessor, a program memory, a non-volatile memory and a main memory connected for digital evaluation during operation to said microprocessor; and said microprocessor, said program memory, said non-volatile memory and said main memory are coupled via said bus to said input/output unit.

16. The configuration according to claim 8, wherein said row is disposed in a direction of a force of gravity.

17. The configuration according to claim 1, wherein said electrodes have a formed selected from the group consisting of hollow cylinders and ring electrodes.

* * * * *